US010591243B2

(12) United States Patent
Houle

(10) Patent No.: US 10,591,243 B2
(45) Date of Patent: Mar. 17, 2020

(54) ARCHERY QUIVER HAVING INDIVIDUAL ARROW HEAD RECEIVING BIASED PLUNGERS

(71) Applicant: PLACEMENTS GASTON HOULE INC., Wickham (CA)

(72) Inventor: Gaston Houle, Wickham (CA)

( * ) Notice: Subject to any disclaimer, the term of this patent is extended or adjusted under 35 U.S.C. 154(b) by 0 days.

(21) Appl. No.: 16/207,090

(22) Filed: Dec. 1, 2018

(65) Prior Publication Data

US 2019/0170471 A1 Jun. 6, 2019

Related U.S. Application Data

(60) Provisional application No. 62/593,300, filed on Dec. 1, 2017.

(51) Int. Cl.
*F41B 5/06* (2006.01)

(52) U.S. Cl.
CPC ..... *F41B 5/066* (2013.01); *Y10S 224/916* (2013.01)

(58) Field of Classification Search
CPC ..... F41B 5/06; F41B 5/066; Y10S 224/916
USPC ..... 124/25.5, 25.7, 86, 88; 224/916
See application file for complete search history.

(56) References Cited

U.S. PATENT DOCUMENTS 2,464,068 A 3/1949 Bear
2,691,399 A 10/1954 Tompkins
2,722,958 A * 11/1955 King ..... F41B 5/063 206/315.11
2,746,658 A 5/1956 Freid
2,768,669 A * 10/1956 Kinnee ..... F41B 5/063 206/315.11
2,771,620 A * 11/1956 Hoffman ..... F41B 5/063 206/315.11
2,816,696 A 12/1957 Stockfleth
2,872,959 A * 2/1959 Stockfleth ..... F41B 5/063 206/315.11
2,897,864 A * 8/1959 Schmidt ..... F41B 5/063 206/315.11
2,905,218 A * 9/1959 Smith ..... F41B 5/063 206/315.11
2,954,764 A 10/1960 Stinson
2,969,898 A 1/1961 Ramsey
2,980,305 A 4/1961 Reese
2,999,620 A 9/1961 Haggard
3,010,502 A * 11/1961 Sundquist ..... F41B 5/063 206/315.11
3,108,725 A 10/1963 Ramsey
(Continued)

OTHER PUBLICATIONS

Bcquiver, Jan. 1, 2016, USA, http://ranchosafari.com/product/bcquiver/.

(Continued)

*Primary Examiner* — Alexander R Niconovich
(74) *Attorney, Agent, or Firm* — Mathieu Audet

(57) ABSTRACT

A quiver for receiving therein a plurality of arrows is hereby presented, the quiver comprising an arrow head receiving portion secured at a first end of an elongated frame and an arrow nock receiving portion secured at a second end of the elongated frame, the arrow head receiving portion comprising a biasing mechanism for longitudinally biasing an arrow toward the arrow nock receiving portion for longitudinally compressing and securing the arrow between the arrow head receiving portion and the arrow nock receiving portion.

20 Claims, 23 Drawing Sheets

(56) References Cited

U.S. PATENT DOCUMENTS

| | | | | | |
|---|---|---|---|---|---|
| 3,114,485 | A | | 12/1963 | Whiffen | |
| 3,166,730 | A | | 1/1965 | Brown | |
| 3,209,740 | A | | 10/1965 | Hauch | |
| 3,286,961 | A | | 11/1966 | Mandolare | |
| 3,465,928 | A | * | 9/1969 | Osterholm | F41B 5/063 224/629 |
| 3,591,062 | A | | 7/1971 | Karbo | |
| 3,595,214 | A | | 7/1971 | O'Malley | |
| 3,601,113 | A | | 8/1971 | Wilkie | |
| 3,696,978 | A | * | 10/1972 | Gentellalli | F41B 5/063 206/315.11 |
| 3,766,954 | A | | 10/1973 | Gentellalli | |
| 4,073,328 | A | * | 2/1978 | Franklin | F41B 5/063 206/315.11 |
| 4,156,496 | A | * | 5/1979 | Stinson | F41B 5/066 124/25.7 |
| 4,247,027 | A | | 1/1981 | Tardiff | |
| 4,363,312 | A | | 12/1982 | Spitzke | |
| 4,522,187 | A | | 6/1985 | Tafel | |
| 4,541,403 | A | | 9/1985 | DeBlois | |
| 4,607,606 | A | | 8/1986 | Schaar | |
| 4,685,438 | A | | 8/1987 | Larson | |
| 4,697,350 | A | | 10/1987 | Shepley | |
| 4,704,800 | A | | 11/1987 | Stinson | |
| 4,785,791 | A | | 11/1988 | Sloop | |
| 4,823,764 | A | | 4/1989 | Knaack | |
| 4,869,226 | A | | 9/1989 | Wu | |
| 4,995,372 | A | * | 2/1991 | Topel | F41B 5/066 124/25.5 |
| 5,215,070 | A | | 6/1993 | Brown | |
| 5,259,359 | A | | 11/1993 | Meredith | |
| 5,425,703 | A | | 6/1995 | Feiring | |
| 5,452,703 | A | * | 9/1995 | Bateman | F41B 5/066 124/25.7 |
| 5,566,665 | A | | 10/1996 | Stinson | |
| 5,775,314 | A | | 7/1998 | Michael | |
| 6,006,734 | A | * | 12/1999 | Sodaro | F41B 5/066 124/25.5 |
| 6,050,252 | A | * | 4/2000 | Etheridge | F41B 5/066 124/25.5 |
| 6,105,566 | A | | 8/2000 | Tiedemann | |
| 6,330,881 | B1 | | 12/2001 | Pippard | |
| 6,390,085 | B1 | * | 5/2002 | Stinson | F41B 5/066 124/25.7 |
| 6,431,162 | B1 | * | 8/2002 | Mizek | F41B 5/066 124/25.5 |
| 6,568,382 | B2 | | 5/2003 | Martin | |
| 6,672,299 | B2 | * | 1/2004 | Proctor | F41B 5/066 124/86 |
| 6,691,694 | B2 | * | 2/2004 | Stinson | F41B 5/066 124/25.5 |
| 6,763,817 | B2 | | 7/2004 | Nickell | |
| 7,077,119 | B1 | | 7/2006 | Dube, Sr. | |
| 7,367,331 | B1 | * | 5/2008 | Horinek | F41B 5/066 124/86 |
| 7,461,647 | B1 | | 12/2008 | Slinkard | |
| 8,006,682 | B2 | | 8/2011 | Vanek | |
| 8,061,341 | B2 | * | 11/2011 | Hudkins | F41B 5/066 124/44.5 |
| 8,505,527 | B2 | * | 8/2013 | Kempf | F41B 5/066 124/86 |
| 8,714,147 | B2 | * | 5/2014 | Walk | F41B 5/066 124/86 |
| 8,839,772 | B2 | * | 9/2014 | Lee | F41B 5/066 124/86 |
| 9,163,895 | B2 | * | 10/2015 | Pedersen | F41B 5/066 |
| 9,372,045 | B1 | * | 6/2016 | Kempf | F41B 5/06 |
| 9,651,330 | B1 | * | 5/2017 | LoRocco | F41B 5/066 |
| 9,829,271 | B2 | * | 11/2017 | McPherson | F41B 5/066 |
| 10,345,071 | B2 | * | 7/2019 | LaBreche | F41B 5/06 |
| 2006/0112945 | A1 | * | 6/2006 | Rager | F41B 5/066 124/86 |
| 2008/0302346 | A1 | * | 12/2008 | Notestine | F41B 5/066 124/25.7 |
| 2011/0174284 | A1 | * | 7/2011 | Hunt | F41B 5/066 124/44.6 |
| 2011/0277739 | A1 | | 11/2011 | Blais | |
| 2012/0085329 | A1 | * | 4/2012 | Vergin | F41B 5/06 124/1 |

OTHER PUBLICATIONS

Rancho-Safari-Catalog—Oct. 2018, Oct. 1, 2018, USA, http://ranchosafari.com/wp-content/uploads/2018/10/Rancho-Safari-Catalog-Oct.2018.pdf.

Allen Platinum Series Quivers, May 21, 2014, USA, Shooters Sporting Center, http://www.shootersni.com/product/allen-platinum-series-quivers-169194.

G5 Mag-Loc Quiver, May 21, 2014, USA, Bowhunting.net, http://bowhunting.net/2010/12/g5-mag-loc-quiver/.

Great Northern Quivers, May 21, 2014, USA, The Footed Shaft, http://www.footedshaftllc.com/catalog/index.php?main_page=index&main.

Quality Bow Mounted Hunting Quivers, May 21, 2014, USA, Hunter's Friend Europe, http://www.huntersfriend.eu/england/quivers-en/quivers-en.html.

Kanati Angle Bow Quiver, Anneewakee Archery, May 21, 2014, USA, kanatiquiver.com, http://www.kanatiquiver.com/Dualarc.html.

Quiver—Catalog, May 21, 2014, USA, fuelthehunt.com, http://www.fuelthehunt.com/quiver1pc.php.

Alpine soft loc quiver, May 21, 2014, USA, alpinearchery.com, http://www.alpinearchery.com/sloc5arrow.html/http://www.alpinearchery.com/2013softlochome.html.

Tight Spot Quivers, May 21, 2014, USA, tightspot.com, http://www.tightspotquiver.com/reason-vibration.

Top Mount Quiver Bracket Option for Scorpyd Crossbow, May 21, 2014, USA, crossbownation.com, http://www.crossbownation.com/forum/topic/16298-top-mount-quiver-bownation.

Top Quivers and Arrow Cases for Bowhunters, May 21, 2014, USA, bowhunter.com, http://www.hunter.com/newproducts_top_quivers_and_arrow_cases.

* cited by examiner

ARCHERY QUIVER HAVING INDIVIDUAL ARROW HEAD RECEIVING BIASED PLUNGERS

CROSS-REFERENCES

The present application is a non-provisional application of, and claims priority under 35 U.S.C. 119(e) to, U.S. provisional patent application No. 62/593,300 filed Dec. 1, 2017, entitled QUIVER, filed under 35 U.S.C. 111(b), application that is incorporated herein by reference in its entirety.

BACKGROUND OF THE INVENTION

1. Field of the Invention

This invention generally relates to a quiver for carrying arrows for use with an arrow-propelling apparatus. The present invention more specifically relates to a quiver adapted to axially secure arrows therein.

2. Description of the Related Art

Bows and crossbows are known since a long time as, originally, a war tool and, later, an alternative to guns for hunting and recreation shooting. Bows and crossbows are designed to propel an arrow when releasing energy from a pair of limbs through a corresponding displacement of a string interconnected thereto.

It is convenient to carry a plurality of arrows with the bow and the crossbow. A quiver is generally used to collect and store one or more arrows in a fashion more or less convenient to get an arrow for being propelled by the string-equipped apparatus.

Early type quivers can be described as a pouch-like recipient designed to receive therein arrows. This kind of quivers needs to be kept in a vertical position and is convenient for quickly placing arrows therein. However, the arrows can drop from the quiver and fall on the ground if the quiver is moved upside down or subjected to significant vibrations.

More recent quivers are preferably individually securing arrows therein. It is more convenient to separate and secure arrows distinctly to space apart broadheads-equipped arrows. Broadheads are generally used for hunting and are equipped with sharp cutting blades that can damage other arrows and broadheads. It might also be difficult to remove an arrow with a broadhead from the quiver, particularly if the arrows are bundled together. Each arrow is secured by its shaft with a shaft-securing receptacle. An arrow can be unsecured from its shaft-securing receptacle with a force orthogonal to the length of the arrow. Arrows can be disengaged from the quiver when moving in bushes and branches. Indeed, bushes and branches can interfere with the arrows in the quiver without attracting the user's attention and disengage one or more arrows from the quiver. The arrows can then be lost.

Prior art quivers are also generally tedious to install and remove from the arrow propelling device. Their securing mechanisms are generally not designed to be easily removable from the arrow propelling device.

Quivers known in the art, once installed on their arrow propelling device, are generally held in a fixed position and are not designed to offer a plurality of easily interchangeable positions to fit various ergonomic configurations.

It is therefore desirable to provide an improved quiver over the existing art that is preventing arrows from disengaging therefrom when a force orthogonal to the arrow is applied to the arrow.

It is desirable to provide a quiver structure over the existing art that allows a plurality of degrees of freedom allowing a variety of installation positions on the arrow propelling device.

It is also desirable to provide a quiver structure over the existing art that allows easy installation and removal from the arrow propelling device.

It is also desirable to provide a quiver structure adapted to be easily and quickly adjusted on the arrow propelling device.

It is equally desirable to provide an improved quiver structure over the existing art that is providing length adjustment to accommodate arrows of different lengths.

It is also desirable to provide an improved quiver structure that protects the arrows' vanes and nocks.

Other deficiencies will become apparent to one skilled in the art to which the invention pertains in view of the following summary and detailed description with its appended figures.

SUMMARY OF THE INVENTION

One aspect of the present invention is to alleviate one or more of the shortcomings of the background art by addressing one or more of the existing needs in the art.

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The invention is generally described as a quiver adapted to individually secure a plurality of arrows therein in a manner preventing disengagement of the arrows when the arrows are subjected to a non-axial force thereon.

Aspects of our work provide, in accordance with embodiments thereof, a quiver configured to axially secure individual arrows therein with an arrow head receiver and an arrow tail nock receiver to which opposed axial forces are applied thereto.

Aspects of our work provide, in accordance with embodiments thereof, a quiver configured to axially secure individual arrows therein and remove one arrow at a time with an axial moment of each arrow.

Aspects of our work provide, in accordance with embodiments thereof, a quiver adapted to receive and secure therein arrows of different shaft diameters.

Aspects of our work provide, in accordance with embodiments thereof, a quiver adapted to be elongated or shortened to receive therein arrows of corresponding length.

Aspects of our work provide, in accordance with embodiments thereof, quivers capable of receiving therein, inter alia, three arrows in a three arrows configuration or five arrows in a five arrows configuration.

Aspects of our work provide, in accordance with embodiments thereof, a quiver securing mechanism allowing securing the quiver on the arrow-propelling device using at least one taper arrow-securing member.

Aspects of our work provide, in accordance with embodiments thereof, a quiver-securing mechanism including a plurality of pivot mechanisms providing a plurality of degree of adjustments in respect to the arrow-propelling device secured thereto.

Aspects of our work provide, in accordance with embodiments thereof, a quiver-securing mechanism providing a 360-degree rotation adjustment capability in respect to the arrow-propelling device secured thereto, the quiver-securing mechanism could be locked any angle between 0-degree and 360-degree.

Aspects of our work provide, in accordance with embodiments thereof, a quiver providing vanes skid guard protecting vanes of arrows secured in the quiver.

Aspects of our work provide, in accordance with embodiments thereof, a quiver with vibration dampening capability.

Aspects of our work provide, in accordance with embodiments thereof, a quiver adapted to be secured in cantilever on one lateral side of a bow to act as a balancing weight depending on the shooter's preferred hand.

Aspects of our work provide, in accordance with embodiments thereof, a quiver for receiving therein a plurality of arrows is hereby presented, the quiver comprising an arrow head receiving portion secured at a first end of an elongated frame; and an arrow nock receiving portion secured at a second end of the elongated frame, the arrow head receiving portion comprising a biasing mechanism for biasing an arrow head receiver toward the arrow nock receiving portion for axially securing an arrow between the arrow head receiving portion and the arrow nock receiving portion.

Aspects of our work provide, in accordance with embodiments thereof, a quiver for receiving and securing therein a plurality of arrows, the quiver comprising an arrow head receiving portion secured at a first end of an elongated frame, the arrow head receiving portion including a plurality of individual arrow retaining mechanisms, and an arrow nock receiving portion secured at a second end of the elongated frame, the arrow nock receiving portion including a plurality of individual nock-engaging elements, each one of the individual nock-engaging elements being longitudinally aligned along a respective arrow longitudinal axis with a cooperating arrow retaining mechanism of the arrow head receiving portion for securing an arrow with a force longitudinally biased against the arrow between the arrow retaining mechanism and the nock-engaging element.

Aspects of our work provide, in accordance with embodiments thereof, a n arrow propelling device equipped with a quiver for receiving and securing therein a plurality of arrows, the quiver comprising an arrow head receiving portion secured at a first end of an elongated frame, the arrow head receiving portion including a plurality of individual arrow retaining mechanisms, and an arrow nock receiving portion secured at a second end of the elongated frame, the arrow nock receiving portion including a plurality of individual nock-engaging elements, each one of the individual nock-engaging elements being longitudinally aligned along a respective arrow longitudinal axis with a cooperating arrow retaining mechanism of the arrow head receiving portion for securing an arrow with a force longitudinally biased against the arrow between the arrow retaining mechanism and the nock-engaging element.

Each of the embodiments of the present invention has at least one of the above-mentioned objects and/or aspects but does not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

DESCRIPTION OF EMBODIMENT(S) OF THE INVENTION

Our work is now described with reference to the figures. In the following description, for purposes of explanations, numerous specific details are set forth in order to provide a thorough understanding of the present invention by way of embodiment(s). It may be evident, however, that the present invention may be practiced without all these specific details.

Figure 1:
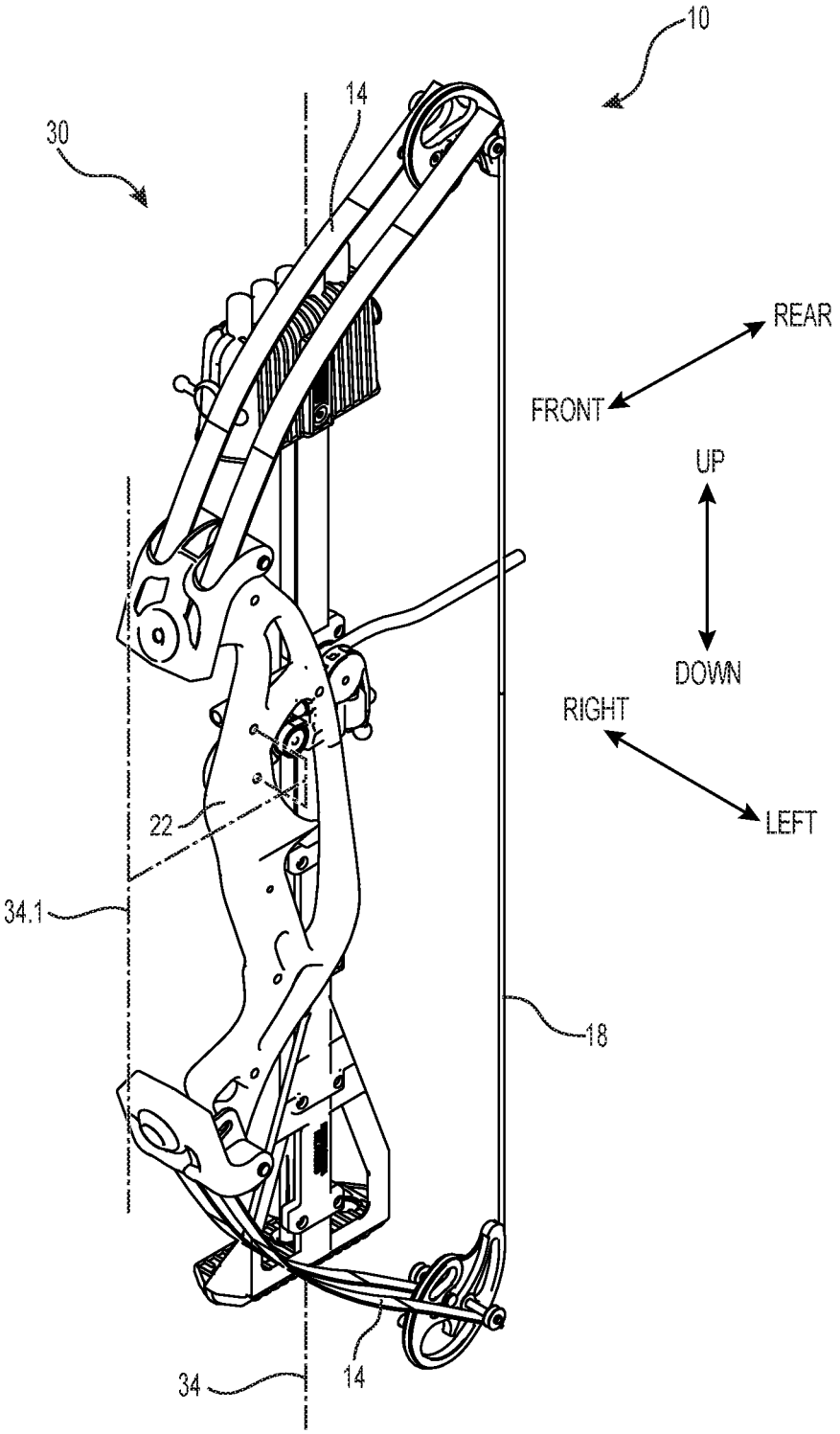
FIG. 1 is an isometric illustration of an exemplary bow with a quiver secured thereto in accordance with embodiments of the present invention.

FIG. 1 illustrates a typical bow 10 with a pair of limbs 14 interconnected by a string 18. The pair of limbs 14 is secured to a central handle 22. A quiver 30 is illustratively secured on the right side of the central handle 22 of the bow 10. The quiver 30 is positioned on the bow 10 with its longitudinal axis 34 in a vertical position along with the vertical direction of the bow 10. The quiver 30 can alternatively be secured and located on the left side of the central handle 22 with its vertical axis 34.1 in cantilever in front of the bow 10 as illustrated in FIG. 1. The latter location of the quiver 10 on the right lateral side in front of the bow 10 can replace the counter weight often used on a bow 10 to balance and stabilize the bow 10 when shooting an arrow (not illustrated in FIG. 1). This helps balance the weight of the bow 10 when equipped with a quiver 30 because the quiver 30, in this embodiment, has a double role, the role of a quiver and the role of a balancing counter weight given its location. That mean that such a quiver equipped bow would spare the weight of a counterweight when the quiver also acts as a counterweight.

Figure 2:
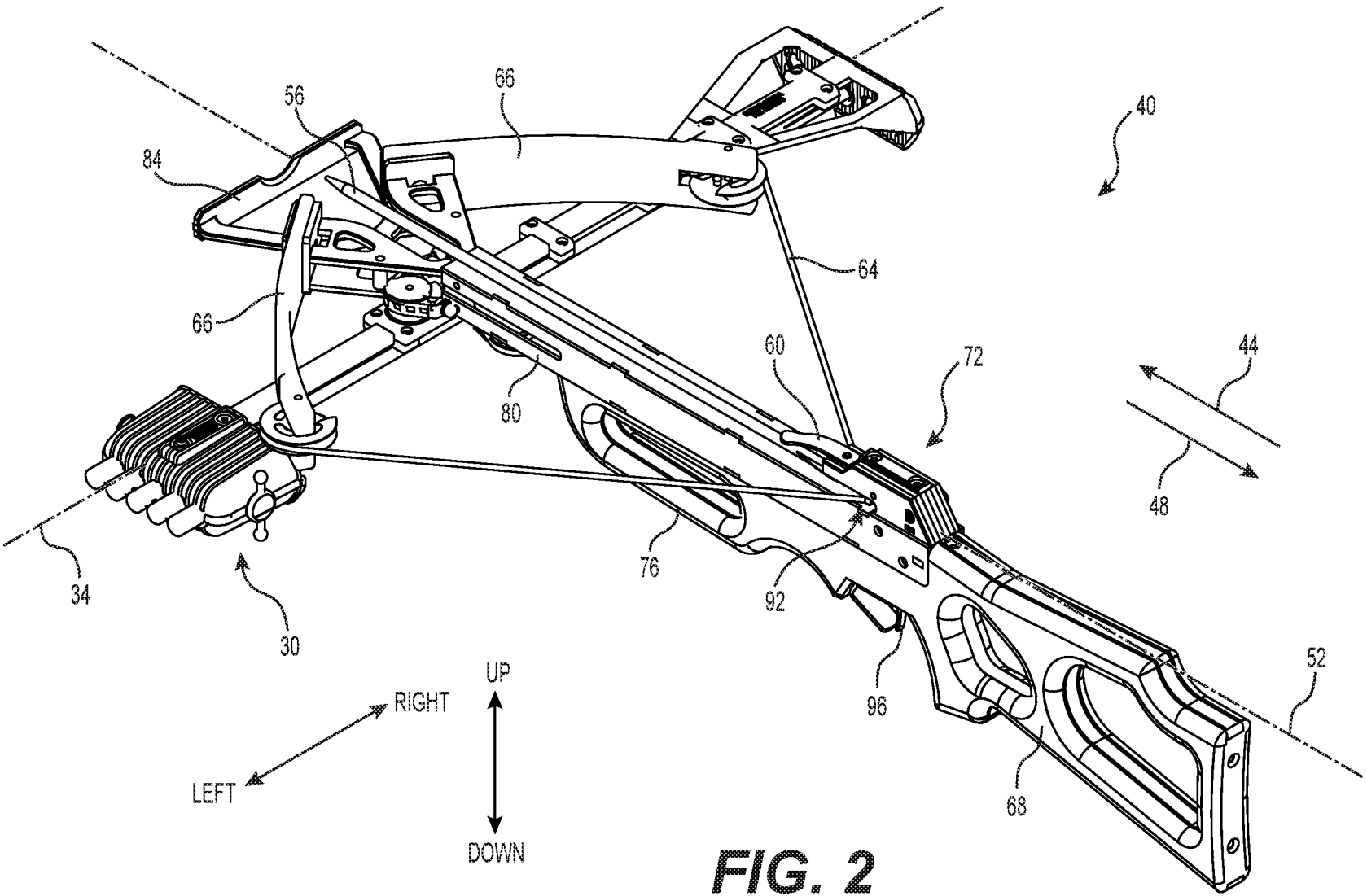
FIG. 2 is an isometric illustration of an exemplary crossbow with a quiver secured thereto in accordance with embodiments of the present invention.

A crossbow 40 is illustrated in FIG. 2, the crossbow 40 includes a side proximal 44 to a user and a side distal 48 to the user when the crossbow 40 is held by a user in a shooting position. The crossbow 40 includes a longitudinal axis 52 along which an arrow 56, when installed on the crossbow 40 in its flight groove and held by an arrow retention spring 60, is properly located to be propelled by a tensed pair of limbs 66 and a string 64 interconnected thereto. The crossbow 40 further comprises a stock 68, a sight bridge 72, a foregrip 76 and a barrel 80. On its distal 48 end, the crossbow 40 has a stirrup 84 disposed thereon for cocking the crossbow 40. The pair of limbs 66 is adapted to be flexed to accumulate energy that is selectively released to propel the arrow 56. The crossbow 40 is further equipped with an optional sight (not illustrated) and a latch 92 holds the tensed string 64 that can be selectively released to propel the arrow 56 upon actuation of the trigger 96 by a user. A quiver 30 is illustratively transversally secured under the crossbow 40. Indeed, the longitudinal axis 34 of the crossbow 40 is substantially orthogonal to the longitudinal axis 52 of the crossbow 40. Alternatively, the quiver 30 could be secured on the upper portion of the crossbow 40. The quiver 30 can also be disposed on the crossbow 30 in with its longitudinal axis 34 parallel with the longitudinal axis 52 of the crossbow 30, either on top or under the crossbow 30. The illustrated positions of the quiver 30 on these arrow propelling devices are for illustrative purpose only and other possible configurations remain within the scope of the present application.

Figure 3:
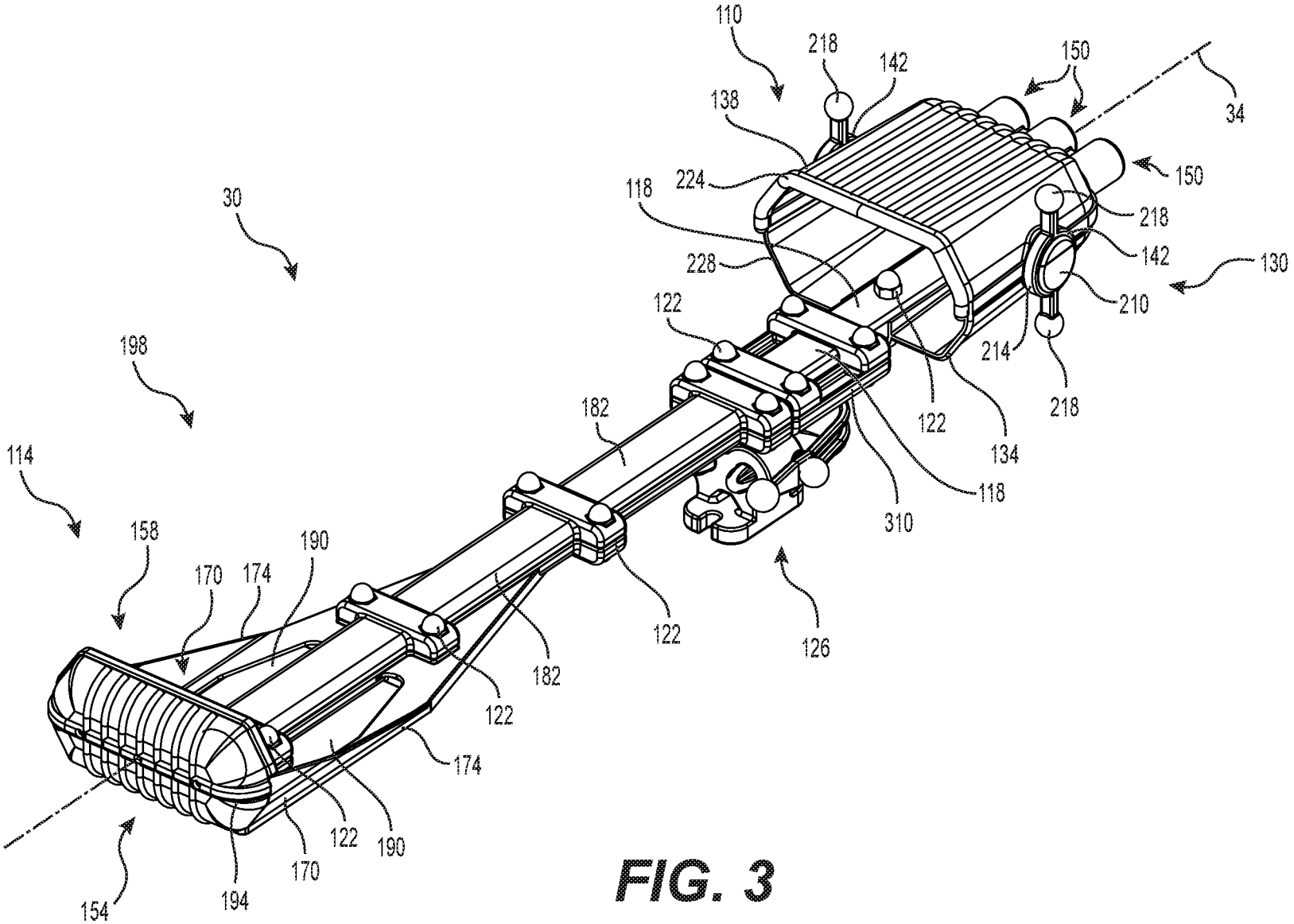
FIG. 3 is an isometric illustration of a quiver in accordance with embodiments of the present invention.
Figure 4:
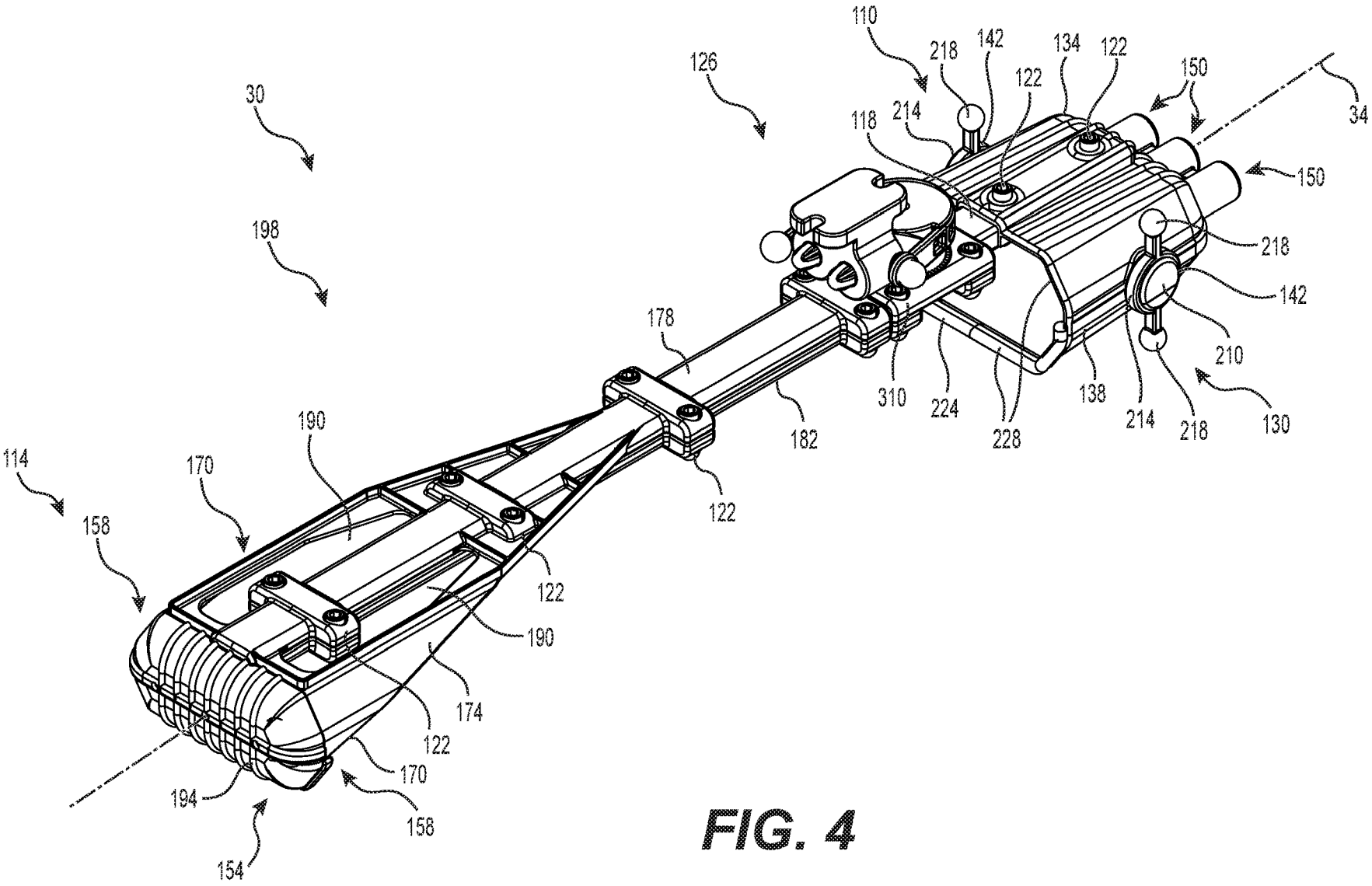
FIG. 4 is an isometric illustration of a quiver in accordance with embodiments of the present invention.
Figure 5:
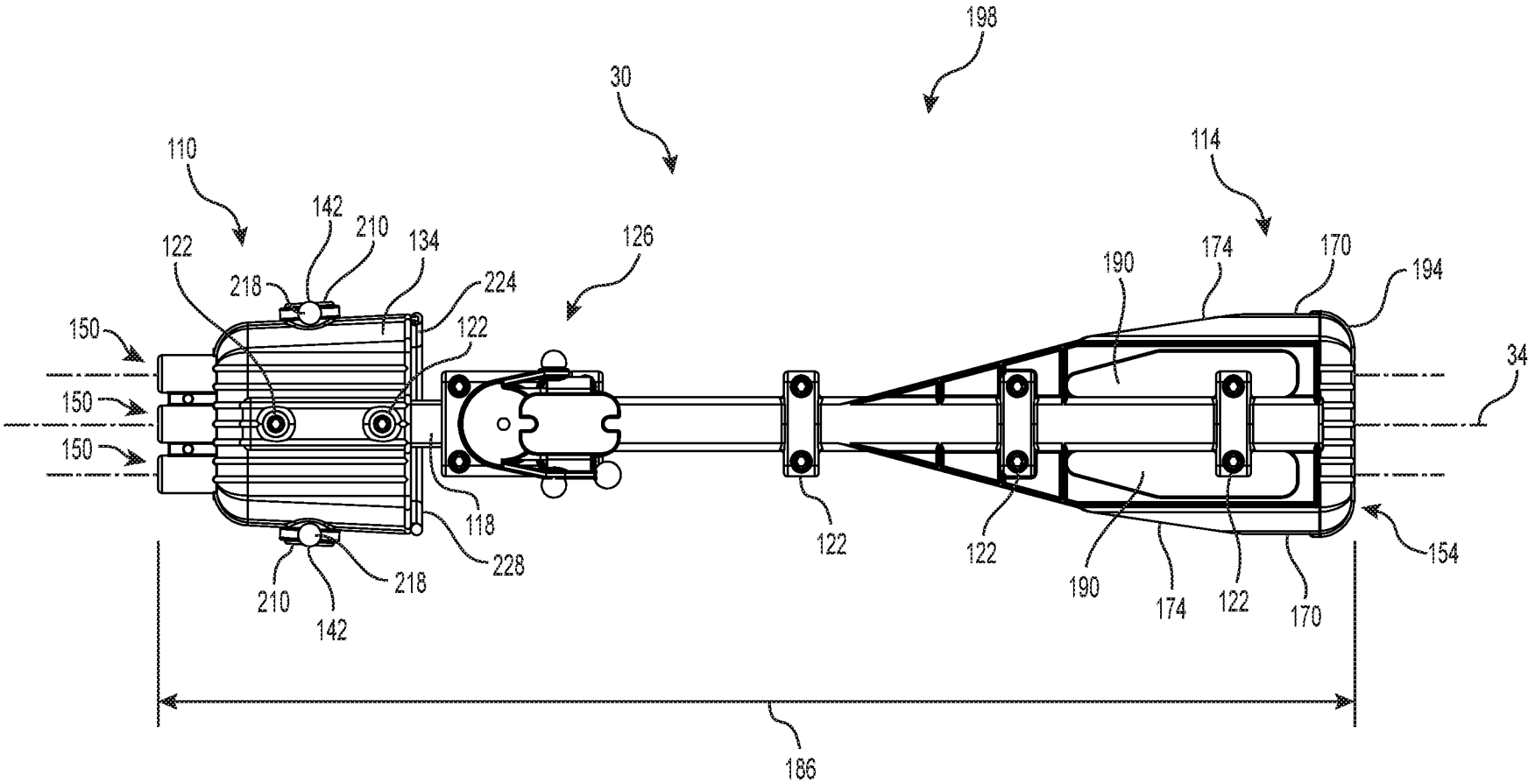
FIG. 5 is a bottom plan view of a quiver in accordance with embodiments of the present invention.
Figure 6:
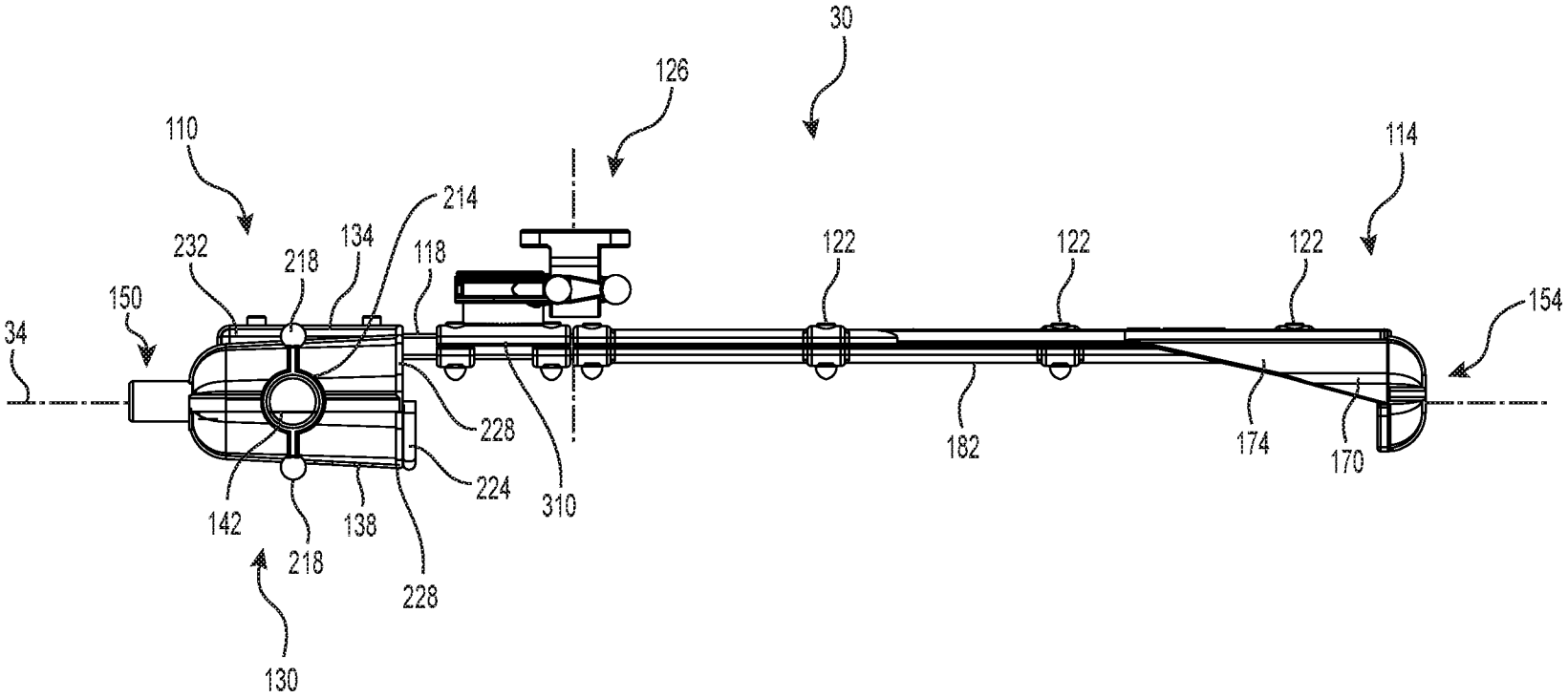
FIG. 6 is a side elevation view of a quiver in accordance with embodiments of the present invention.
Figure 7:
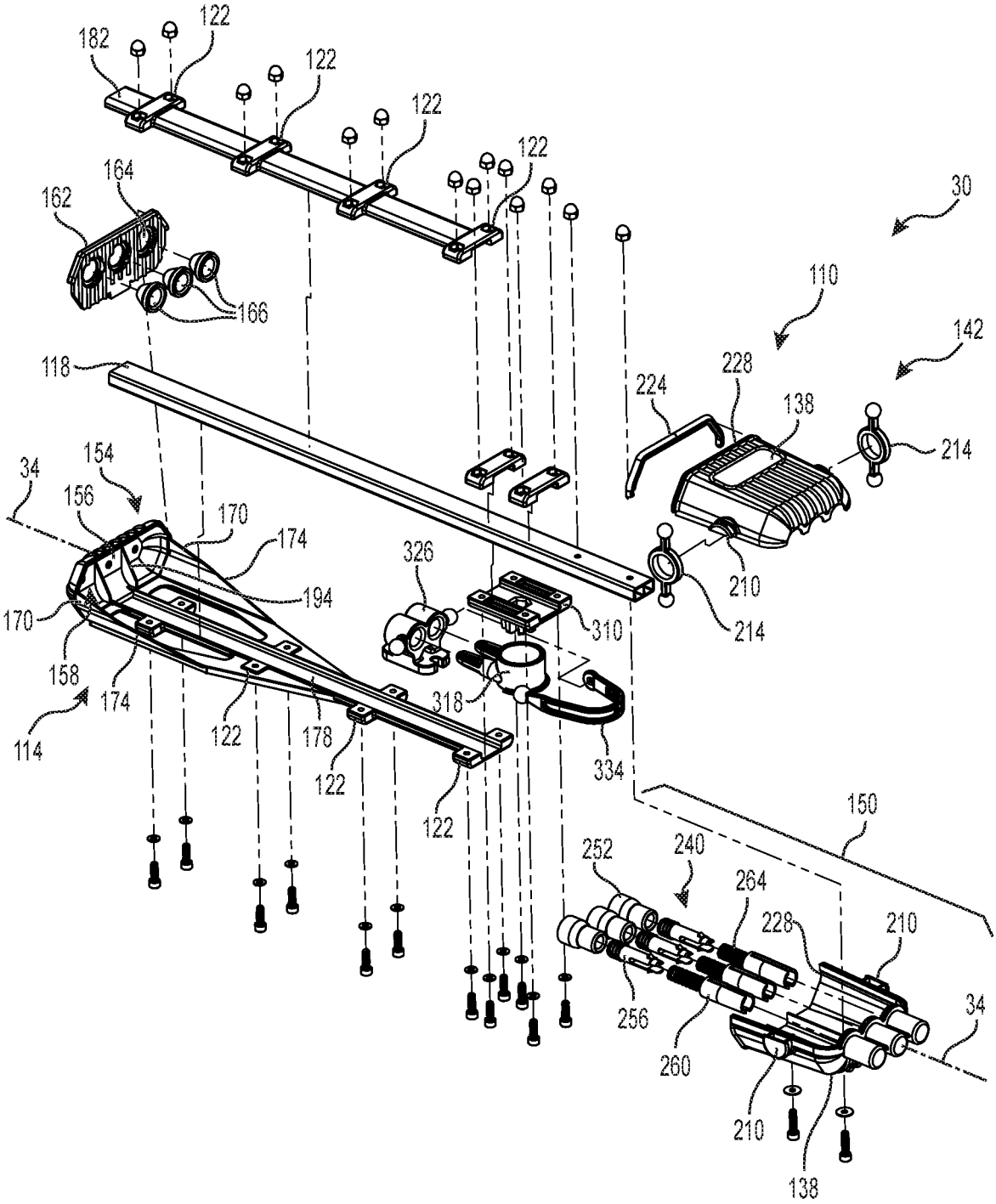
FIG. 7 is an exploded isometric illustration of quiver in accordance with embodiments of the present invention.
Figure 20:
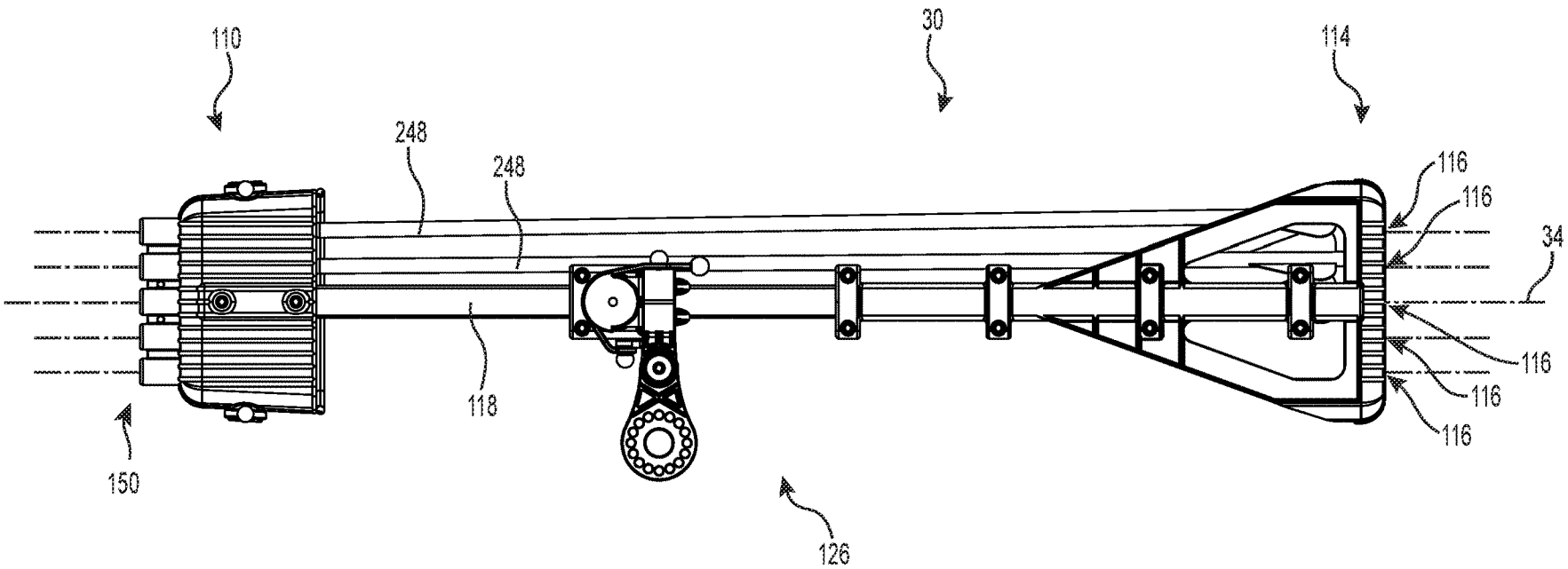
FIG. 20 is a bottom plan view of a quiver in accordance with embodiments of the present invention.
Figure 21:
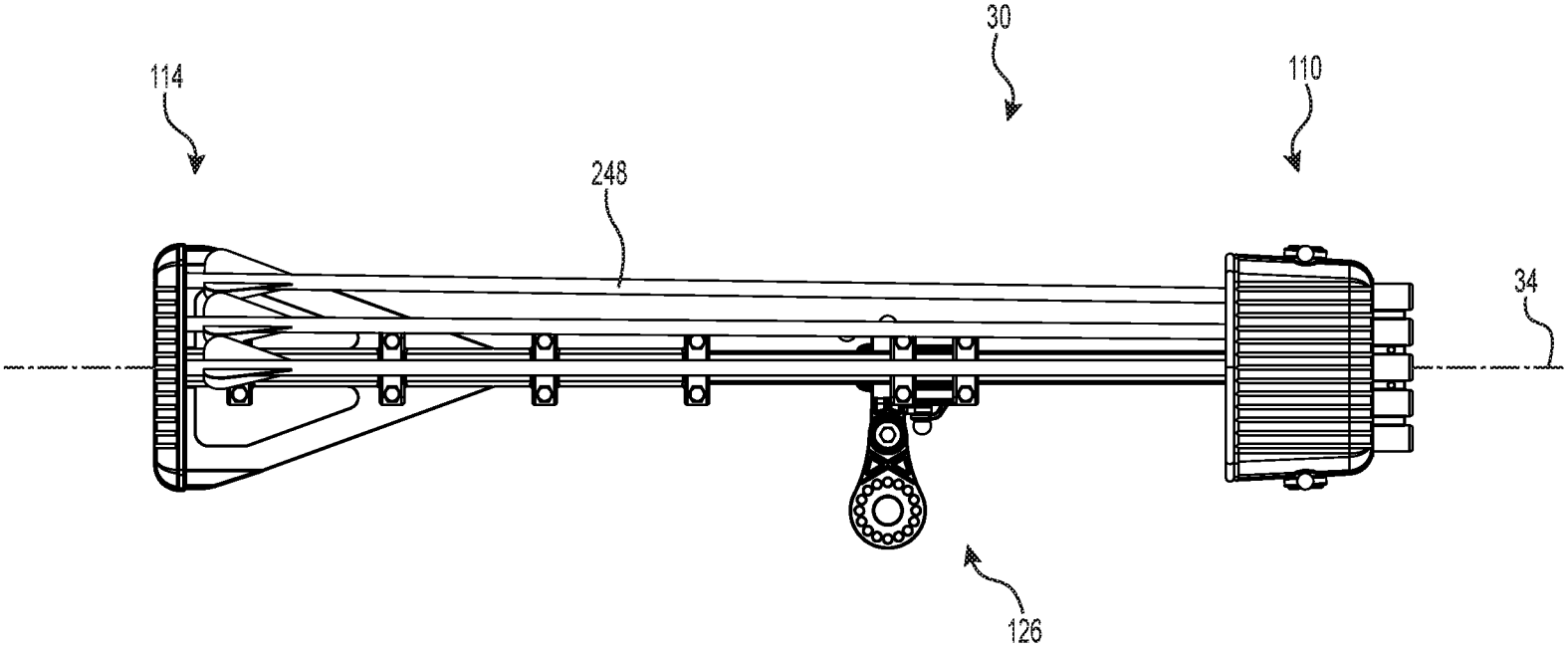
FIG. 21 is a top plan view of a quiver in accordance with embodiments of the present invention.
Figure 22:
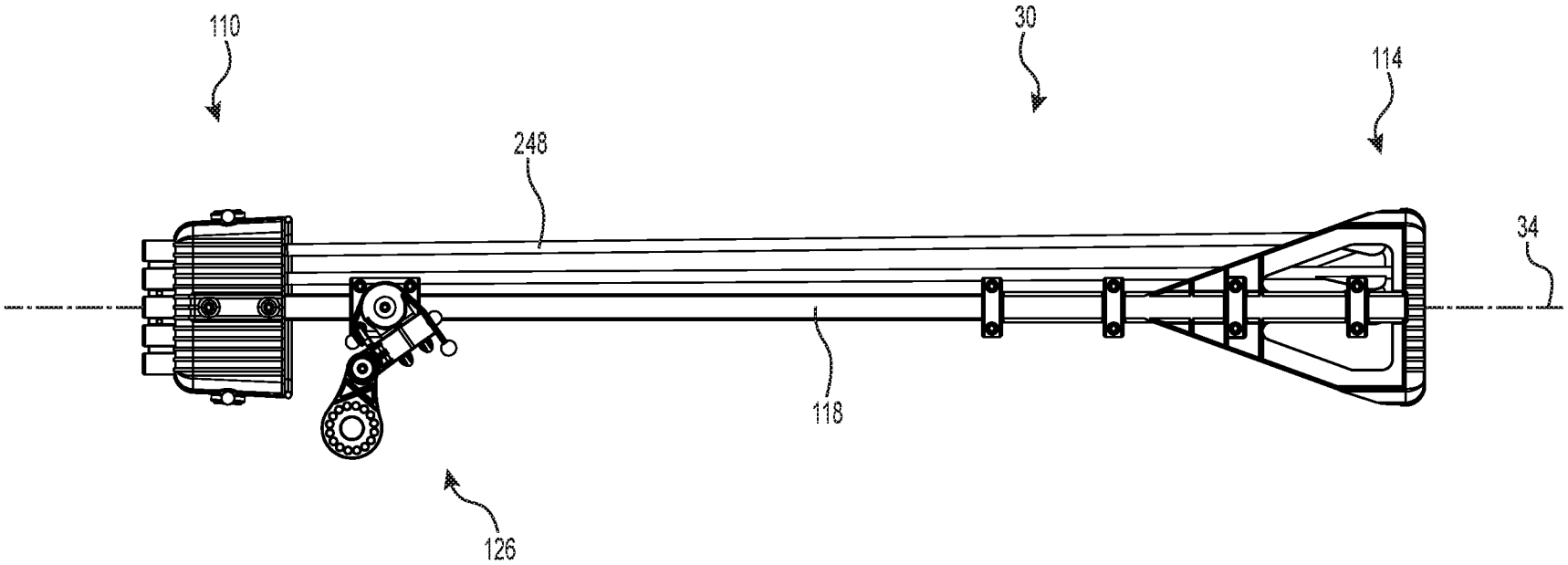
FIG. 22 is a bottom plan view of a quiver in accordance with embodiments of the present invention.

A quiver 30 is illustrated in FIG. 3 throughout FIG. 7. The quiver 30 is configured to accommodate three arrows (not illustrated), however, the quiver 30 can be configured to accommodate a different number of arrows therein as depicted in FIG. 20 illustrating a quiver 30 in a configuration accommodating five arrows 56. As shown in FIG. 3 throughout FIG. 7, the quiver 30 includes an arrow head receiving portion 110, at a first end thereof, and an arrow nock receiving portion 114 at a second end thereof. The arrow head receiving portion 110 and the arrow nock receiving portion 114 are interconnected with a quiver frame embodied as an elongated frame 118 with a plurality of securing elements 122. A quiver securing mechanism 126 is affixed to the elongated frame 118. The elongated frame 118 used in the embodiment is made of a light and non-corrodible extruded metallic channel, like aluminum, or other comparable material. The arrow head receiving portion 110 comprises a hood (archery term) 130 adapted to protect the arrow heads (not illustrated) of arrows 56 held inside the quiver 30. The arrow head receiving portion 110 is sized and designed to accommodate the entire broadheads of the arrows to protect the user against being cut and injured by the sharp edges of the broadhead and also to prevent the broadheads to become dull. The hood 130 is embodied with two detachable sections 134, 138 to give access to the interior of the hood 130. Both detachable sections 134, 138 are secured together by a securing mechanism 142. The illustrated quiver 30 is depicted with its longitudinal axis 34. The arrow head receiving portion 110 also houses a plurality of individual arrow retaining mechanisms 150 that are going to be described in further details below.

Figure 9:
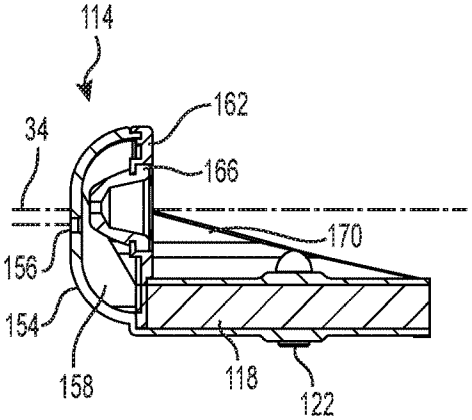
FIG. 9 is a side elevation section view of a portion of the quiver of FIG. 8 in accordance with an embodiment of the present invention.
Figure 14:
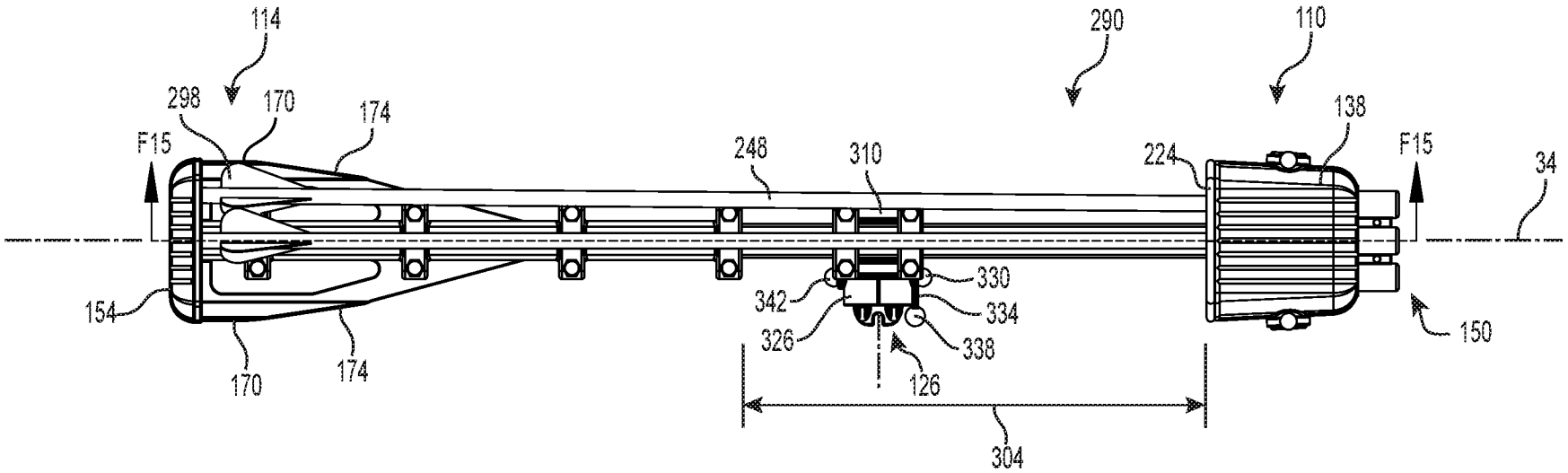
FIG. 14 is a top plan view of a quiver in accordance with embodiments of the present invention.

Still referring to FIG. 3 throughout FIG. 7, however best seen in FIG. 9, the arrow nock receiving portion 114 includes a nock receiver portion 154 defining a generally concave portion 158 configured to receive and secure therein a receiver portion 162 adapted to locate and maintain a plurality of nock-engaging elements 166. Each nock-engaging element 166 is longitudinally aligned with its respective arrow retaining mechanism 150 to axially compress and secure an arrow therebetween. The receiver portion 162 is embodied in plastic and provided with a series of openings 164 therein sized and designed to receive and secure therein the plurality of nock-engaging elements 166. The nock-engaging elements 166, in the present embodiment, are generally round with a conical or frustoconical cavity for receiving and self-centering therein an arrow's nock 276 to ensure alignment of the arrow 56. The nock receiver portion 154 is provided, in accordance with an embodiment thereof, with at least one drain hole 156 to allow water to drain out, when required. The arrow nock receiving portion 114 includes a pair of side edges 170 extending into a pair of vanes skid guards 174 for protecting vanes of arrows secured in the quiver 30. The vanes skid guards 174 are extending over about the area covered by the vanes 298 to protect the vanes 298 against foreign objects that could damage the vanes 298 of the arrows 248 and be detrimental to the precision of the arrows 248. The vanes skid guard 174 are sized and designed to protect the vanes of the arrows located on lateral edges of the quiver 30 and a back portion of the arrow nock receiving portion 114 is protecting the back of the vanes of the arrows. The back half of the arrow nock receiving portion 114 is used to protect the vanes in this embodiment although the proportion of vanes protection around the vanes could vary in other embodiments as long as the arrows can be extracted from the quiver 30 in a convenient manner. The profile of the vanes skid guard 174 are substantially matching the profile of the vanes, ideally with a wider covering, to prevent foreign objects to interfere with the vanes of the arrows when the quiver 30 contains arrows 56 therein as best seen in FIG. 14. For instance, the vanes skid guards 174 are protecting arrows' vanes against branches and other foreign objects to prevent damaging the vanes when moving in the woods/forest. The front portion of the arrow nock receiving portion 114 is substantially flush with the nock-engaging elements 166 to facilitate extraction of the nock side of the arrow from the nock receiving portion 114 when removing the arrow from the quiver 30.

Still referring to FIG. 3 throughout FIG. 7, an elongated frame receiver 178 is centrally disposed in the nock receiving portion 114 along the back portion of the arrow nock receiving portion 114 to slidably receive therein the elongated frame 118. The elongated frame receiver 178 is provided with a plurality of securing elements 122 adapted to cooperate with an elongated frame receiver cover 182. The elongated frame receiver 178 and its corresponding elongated frame receiver cover 182, once assembled, are allowing a slide fit with the elongated frame 118, slide fit that becomes a fit when the securing elements 122 are tightly secured hence preventing longitudinal movement of the elongated frame 118 in respect with the nock receiving portion 114. The relative position of the elongated frame 118 with the nock receiving portion 114 and with the arrow head receiving portion 110 are allowing an adjustment of a length 186 of the quiver 30 (illustrated in its compressed configuration) to accommodate arrows 56 of different lengths (generally between 40 centimeters to 60 centimeters for crossbows and between 66 centimeters 86 centimeters for bows). Openings 190 and ribs 194 are embedded in the nock receiving portion 114 to stiffen and lighten the part. The nock receiving portion 114 is embodied in plastic for mass production, preferably in tactical mate black color for its stealth effect in the woods.

As indicated above, the arrow head receiving portion 110 is composed of two detachable portions 134, 138 secured together by a securing mechanism 142. The securing mechanism 142 is embodied with two cooperating lateral protrusions 210 held together by an elastomeric securing element 214 that can be stretched to get over the protrusions 210 and hold the protrusions 210 together when retracting to its original state. The elastomeric securing element 214 is further embodied with a pair of gripping protrusions 218 used to stretch the elastomeric element 214 upon installation and removal from the lateral protrusions 210. The gripping protrusions 218 also have vibration damping capability given their cantilevered mass and their vibration absorbing material. An edge cover 224 is optionally installed on one or both edges 228 of the arrow head receiving portion 110. The edge cover 224 is preferably made of soft and durable material to sustain contacts with broadheads' sharp edges to reduce the noise and prevent damaging the arrow head receiving portion 110. In the illustrated embodiment, an edge cover 224 is disposed only on the detachable portion 138 although a second edge cover 224 could be used on the other detachable portion 138. A frame-receiving cavity 232 is defined in the arrow head receiving portion 110 to receive an end of the elongated frame 118 therein. The elongated frame 118 is secured in the frame-receiving cavity 232 with some fasteners 236.

Figure 11:
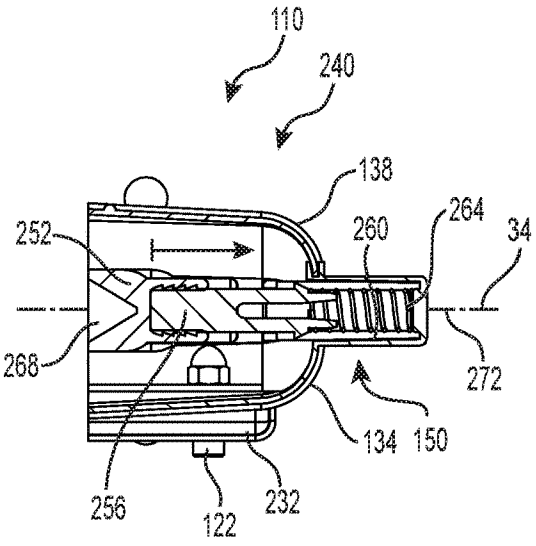
FIG. 11 is a side elevation section view of a portion of the quiver of FIG. 8 in accordance with an embodiment of the present invention.
Figure 10:
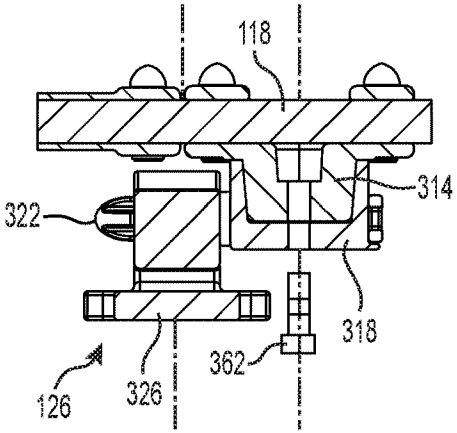
FIG. 10 is a side elevation section view of a portion of the quiver of FIG. 8 in accordance with an embodiment of the present invention.

As best seen in FIG. 7, FIG. 11, FIG. 13 and FIG. 15, the arrow head receiving portion 110 contains a plurality of arrow-retaining mechanisms 240. The arrow-retaining mechanism 240 is used to apply an axial pressure against the arrow head 244 to axially compress the arrow 248 against the arrow nock receiving portion 114 and secure the arrow in the quiver 30. The arrow must be axially moved toward the arrow-retaining mechanism 240 in a compressed configuration thereof to axially liberate the nock portion of the arrow from the arrow nock receiving portion 114. Once the arrow-retaining mechanism 240 is compressed and the nock portion of the arrow is removed from the arrow nock receiving portion 114, it is possible to radially move the nock portion of the arrow out of the arrow nock receiving portion 114, remove the compression on the arrow-retaining mechanisms 240 and remove the arrow from the quiver 30. The arrow-retaining mechanism 240 includes an arrow head receiver 252 connected to a plunger 256 sized to slide into a corresponding plunger receiver 260 that is housed inside the arrow head receiving portion 110. The plunger 256 is configured to slidably interconnect the plunger receiver 260 to move against a compression spring 264, as illustrated in FIG. 7 and FIG. 11, without disengaging from the plunger receiver 260 when it is in its extended configuration. A slot and peg mechanism is used in the present embodiment to secure the plunger 256 with the plunger receiver 260. The compression spring 264 used in the embodiment has a substantially constant pressure of about 0.4 kg. The arrow head receiver 252 includes a cavity 268 therein to receive an arrow head 244 at an intended position aligned with an arrow-retaining mechanisms axis 272. The cavity 268 is preferably conical to be self-centering, however, other shapes or forms could be used without departing from the scope of the present invention. The arrow head receiver 252 is secured, in the illustrated embodiment, to the plunger 256 with a series of securing serrations therein, or the like. Glue or welding could alternatively be used to secure the components together. In an embodiment, the arrow head receiver 252 is made of a reasonably soft rubber for contacting sharp blades of a broadhead without being cut and generating noise under actuation thereof. A distinctive color, like orange in a suggested embodiment, can be helpful for a user to properly align the arrow at the right place when inserting an arrow in the quiver 30. The nock-engaging element 166 can also be of the same material for generally similar reasons.

To insert and secure an arrow 248 in the quiver 30, as indicated above, a user must manually insert the arrow head 244 inside the arrow head receiver 252 and push the arrow 248 along its axis 272 toward the arrow head receiving portion 110 to compress the arrow retaining mechanism 240 and created sufficient longitudinal length between the arrow head receiving portion 110 and the nock-engaging element 166. Then move the opposite side of the arrow 248, the nock side 276 of the arrow 248, aligned toward the nock-engaging element 166, and axially move the nock side 276 of the arrow 248 against the nock-engaging element 166 when the arrow retaining mechanism 240 returns toward its extended configuration to axially secure the arrow 248 between the arrow head receiver 252 and the nock-engaging element 166 with the axial bias of the arrow-retaining mechanism 240. This way, the arrow 248 is axially secured in the quiver 30 and an axial movement of the arrow 248 against the axial bias of the arrow-retaining mechanism 240 is required for removing the arrow 248 from the quiver 30. Other non-axial forces acting in a different direction on the arrow 248 could not reasonably disengage the arrow 248 from the quiver 30.

Figure 13:
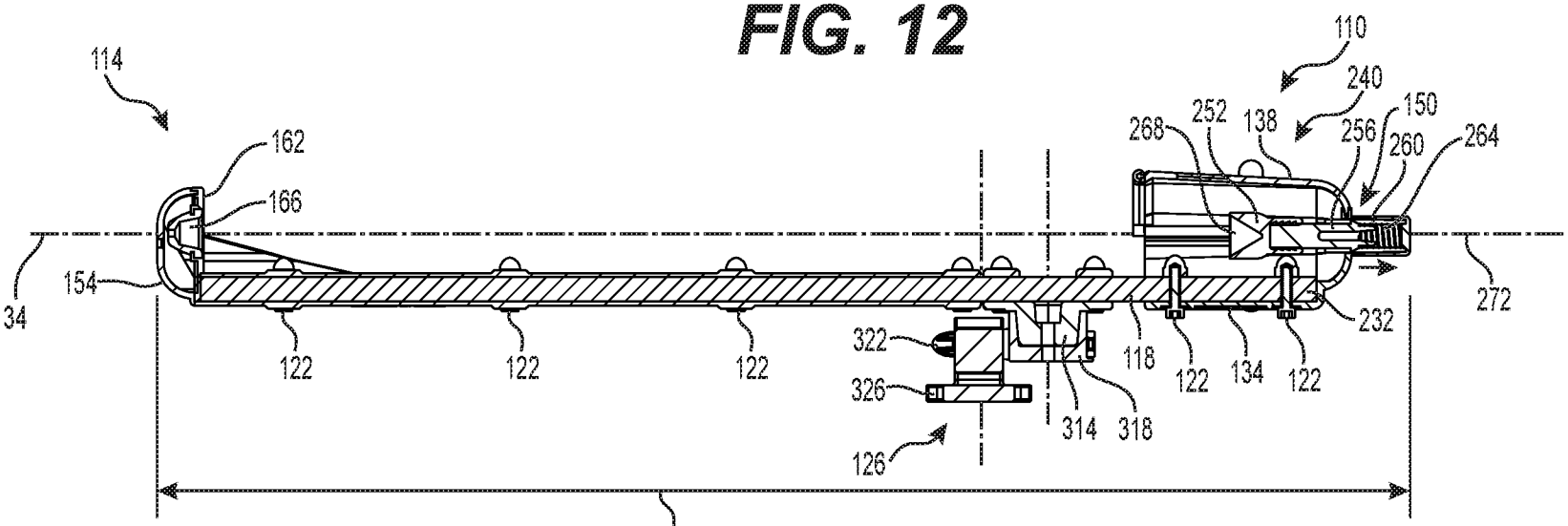
FIG. 13 is a side elevation section view of the quiver of FIG. 12 in accordance with an embodiment of the present invention.
Figure 15:
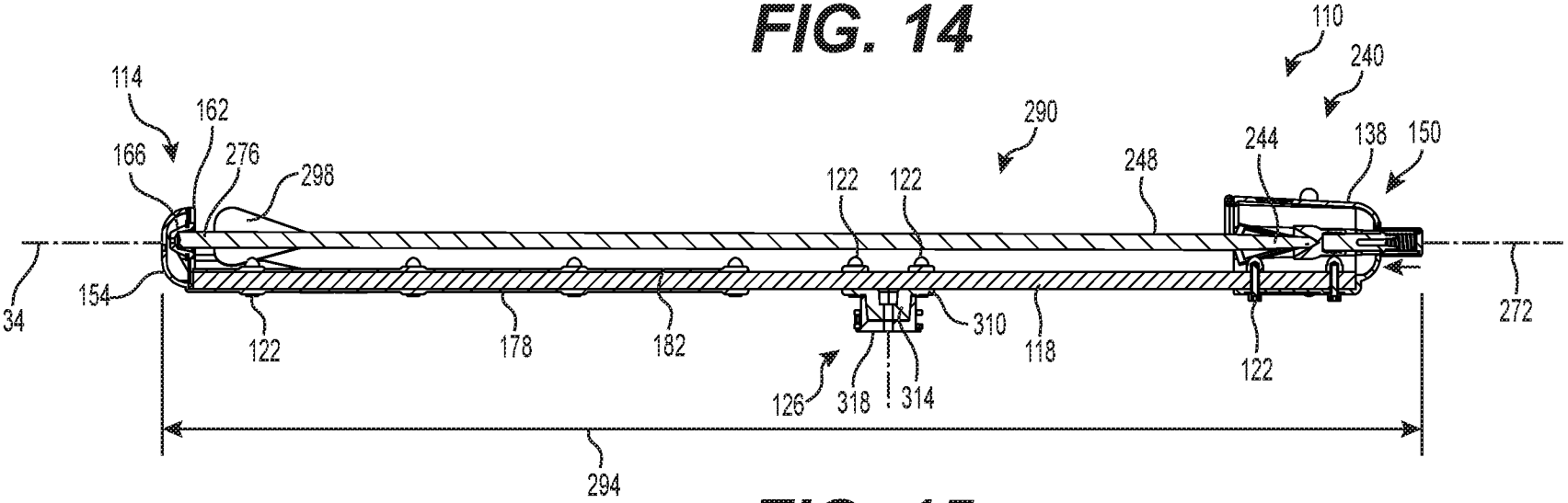
FIG. 15 is a side elevation section view of the quiver of FIG. 14 in accordance with an embodiment of the present invention.
Figure 17:
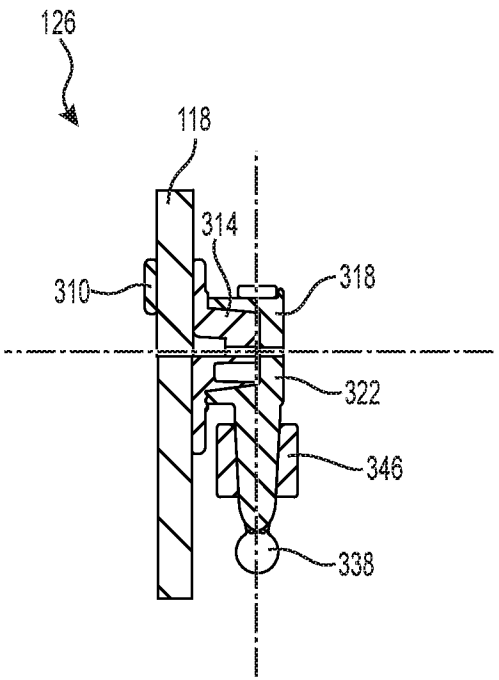
FIG. 17 is a section side elevation view of a portion of a quiver securing mechanism in accordance with embodiments of the present invention.

FIG. 11 is illustrating the arrow-retaining mechanism 240 in the expanded configuration while FIG. 13 is illustrating the arrow-retaining mechanism 240 in the compressed configuration, after, for instance, about 12-20 mm of compression travel. Finally, FIG. 15 illustrates an arrow 248 secured between the arrow head receiving portion 110, in the arrow head receiver 252, and longitudinally corresponding nock-engaging element 166 in the arrow nock receiving portion 114. One can appreciate both the arrow head receiver 252 and the nock-engaging element 166 are providing a self-aligning conical concave contact portion with the arrow 248 to ensure ease of engagement of the arrow 248 and proper axial self-alignment of the arrow 248 in the quiver 30. The conical shape also allows for receiving arrow heads 244 and nock portions 276 of various diameters without jeopardizing the installation and the alignment in the quiver 30.

The quiver 30 is designed to accommodate various distances between the arrow head receiving portion 110 and the arrow nock receiving portion 114. In reference with FIG. 14 and FIG. 15, the illustrated quiver 30 is depicted in a long configuration 290 with a length 294 adapted to accommodate longer arrows 248 therein. The length of the quiver 30 can be adjusted at any desired length between a short configuration 198 and the long configuration 290 to fit any arrows' length. The quiver length adjustment mechanism is embodied with the plurality of securing elements 122 along the elongated frame 118. The length of the quiver 30 can be adjusted when the securing elements 122 are loosed and the length is maintained upon securing the securing elements 122 after a desired quiver length is set. Securing elements 122 are using small bolts as fasteners.

Figure 8:
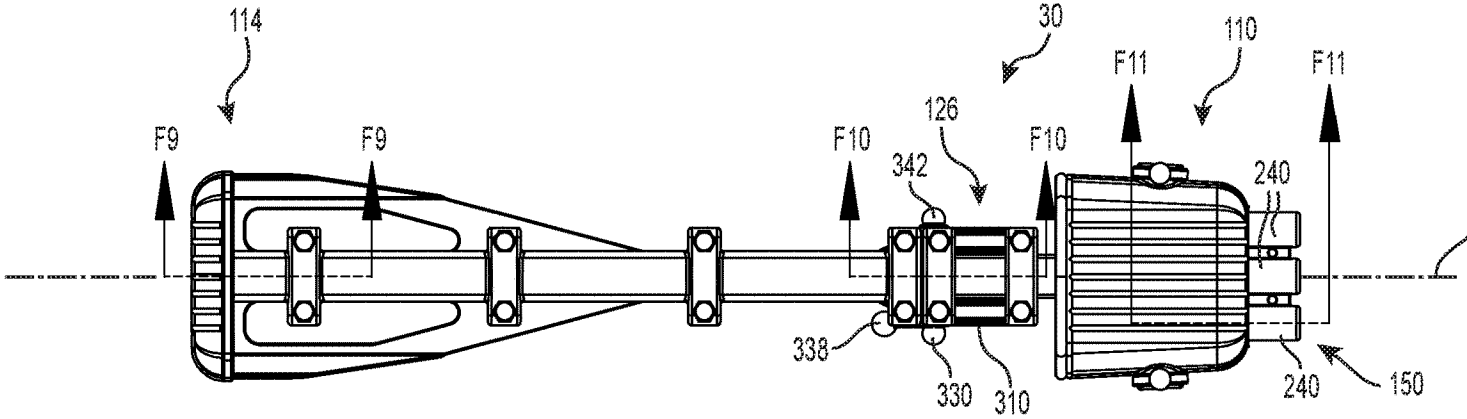
FIG. 8 is a top plan view of a quiver in accordance with embodiments of the present invention.
Figure 12:
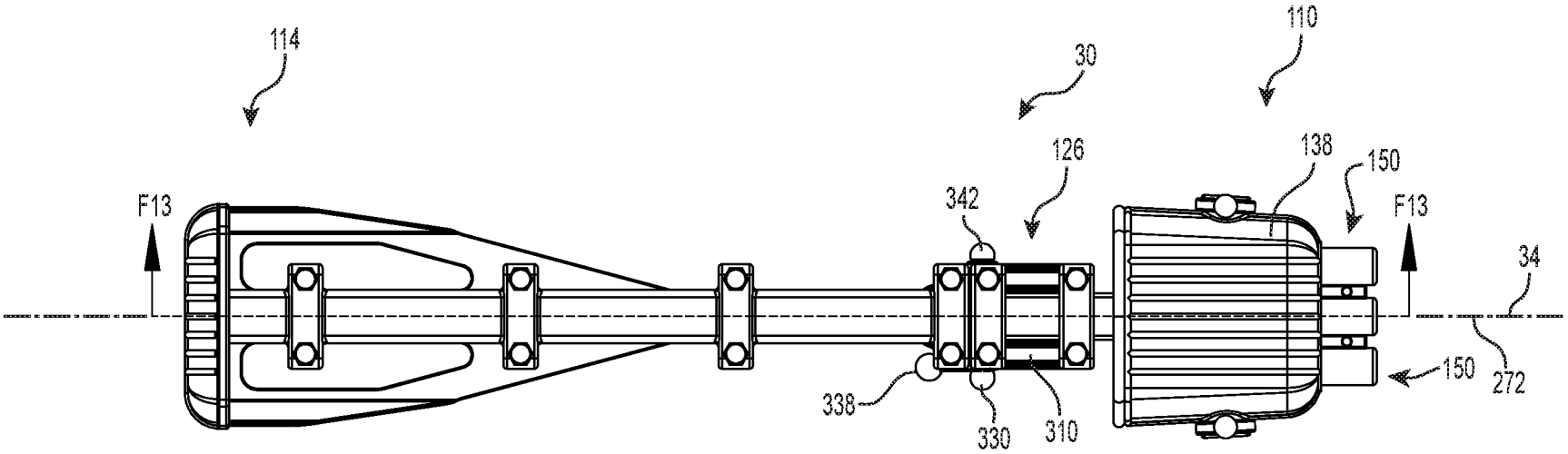
FIG. 12 is a top plan view of a quiver in accordance with embodiments of the present invention.

The quiver securing mechanism 126 can be moved 304 along the elongated frame 118 when the securing elements 122 are loosed, for a degree of adjustment of the quiver 30 in relation with the arrow propelling device or other support means and secured in place by tightening the securing elements 122, as illustrated in FIG. 14 and FIG. 15. As best seen in FIG. 8, FIG. 12 and FIG. 14, the quiver securing mechanism 126 includes a slider 310 equipped with a pair of securing elements 122 adapted to allow sliding adjustment along the elongated frame 118 for locating the quiver 30 at a desired location thereon. The slider 310 includes a first pivot 314 that can be embodied as a toothed circular pivot 314 sized and designed to rotatably receive thereon an operatively corresponding connector 318. The first pivot offers a first degree of freedom to the assembly and could be embodied in different fashions without departing from the scope of the present invention. The pivot 314, preferably, includes a circular tapered protruding shape ensuring a reliable grip with the corresponding, corresponding tapered, female toothed connector 318 when secured with the axial fastener 362. The circular pivot 314 allows for a 360-degree rotation of the connector 318 hence providing a complete rotation to meet many desirable orientations of the quiver 30 in respect with, for instance, the arrow propelling device, the quiver-securing mechanism could be locked any angle between 0-degree and 360-degree. The angle can be changed when the axial fastener 362 is unscrewed and the assembly is loosed to allow disengagement of the toothed assembly for rotating the intervening parts and screw back the axial fastener 362 to secure the assembly with the desired intervening angle thereof. This is a degree of adjustment provided by the quiver securing mechanism 126. The connector 318 further comprises a locking mechanism that is embodied as a pair of engagement members 322 for engaging a corresponding support 326, in a first embodiment thereof. The support is a component that can be secured directly or indirectly to the string equipped apparatus for securing the quiver to the string equipped apparatus. The pair of engagement members 322 are preferably tapered to ensure a tight fit with the support 326 and also to prevent any possible rattle between the parts that could generate noise and be detrimental to fruitful hunting. The pair of engagement members 322 are providing a quick, intuitive and efficient means for connecting and disconnecting the quiver 30 from the arrow propelling device. Indeed, the support 326 can be fixedly connected to the arrow propelling device and disconnection of the support 326 used for directly securing the quiver 30 to the arrow propelling device is allowing easy removal of the quiver 30. The connector 318 is equipped with two engagement members 322 forming an assembly preventing pivotal of the quiver 30 while the tapered shape builds a strong and tight connection between the parts. As illustrated in FIG. 7 and in FIG. 16, the support 326 is equipped, for example, with an elastic securing belt 334 configured to pass over a portion of the periphery of the connector 318 and selectively engage a belt blocker 330 for securing the support 326 to the connector 318. The securing belt 334 is reasonably elastic and is secured to the support 326, at a first end thereof, with an engagement element 342 ending with a knob 338 for efficient grasping, at a second end thereof, for easy manual installation and tightening of the securing belt 334.

Figure 16:
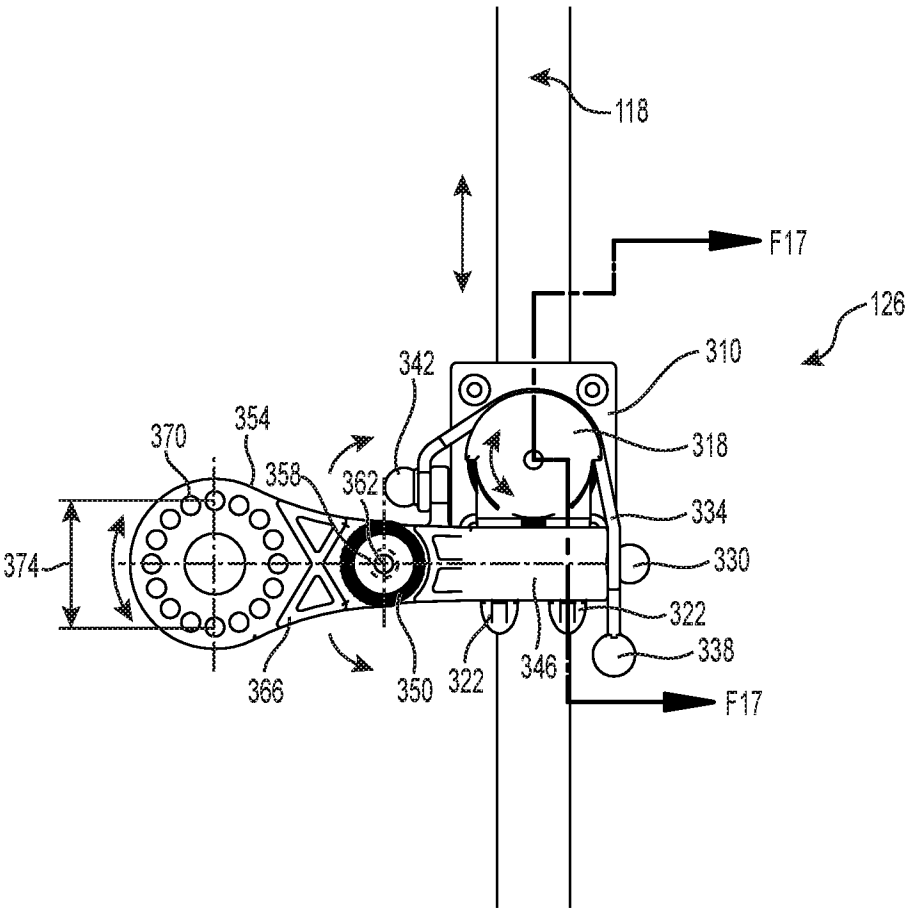
FIG. 16 is a bottom plan view of a quiver securing mechanism in accordance with embodiments of the present invention.
Figure 19:
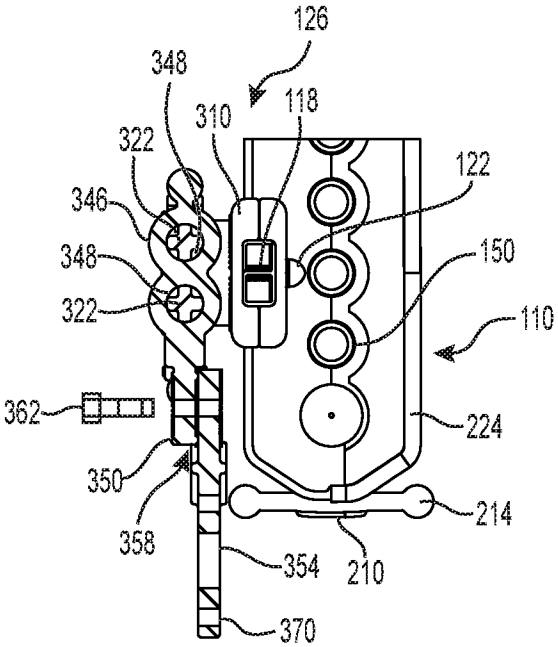
FIG. 19 is a section front elevation view of a portion of a quiver securing mechanism in accordance with embodiments of the present invention.
Figure 18:
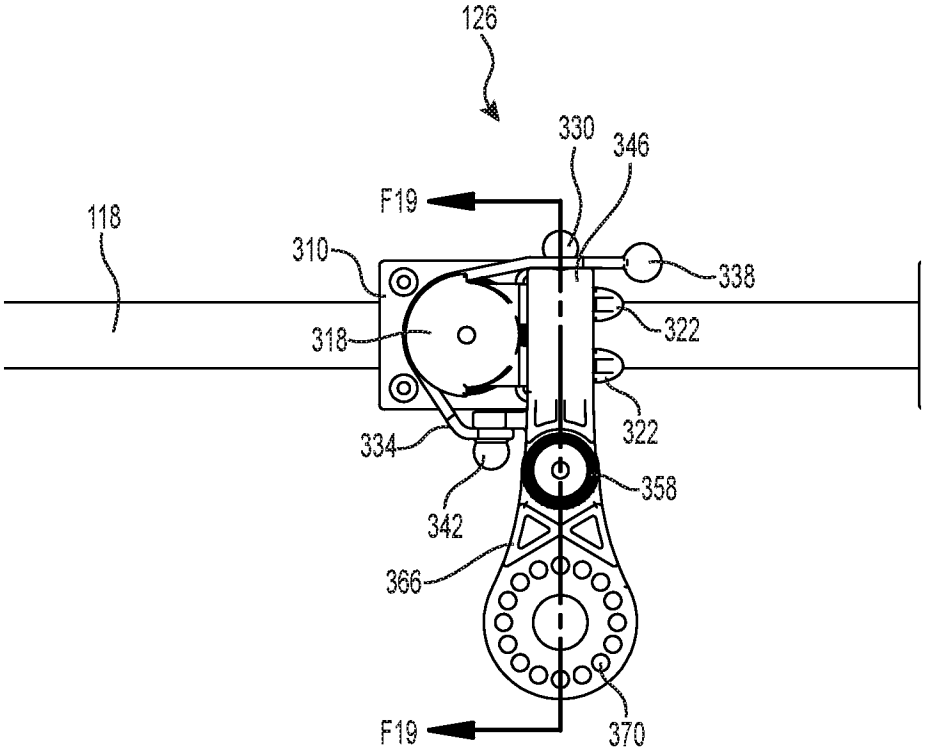
FIG. 18 is a bottom plan view of a quiver securing mechanism in accordance with embodiments of the present invention.

Another degree of adjustment is provided by another alternate embodiment including a connector member 346 equipped with a pair or engagement member receivers 348 with a second pivot 350 as illustrated in FIG. 16 throughout FIG. 20. The second toothed pivot 350, as embodied, provides a means for selectively angularly connect a connector extension 354. The toothed pivot 350 includes a series of teeth 358 disposed about a 360-degree array that can angularly secure the connector extension 354 at most angle thereof by tightening a central fastener 362 when the parts are assembled at a desired angle thereof. The second pivot offers a second degree of freedom to the assembly and could be embodied in different fashions without departing from the scope of the present invention. The connector extension 354 includes a pattern of reinforcement ribs 366, a pair of compatible engagement member receivers 348 and an array of holes 370 as it can be appreciated in FIG. 16. The array of holes 370 can be appreciated as a third pivot in the quiver securing mechanism assembly. The array of holes 370 is adapted to provide a plurality of securing positions with a standard two bolts securing pattern commonly used on bows 10 and crossbows 40 (1.3-inch center-center distance therebetween 374) hence providing a degree of adjustment between the quiver 30 and the arrow propelling device. The third pivot offers a third degree of freedom to the assembly and could be embodied in different fashions without departing from the scope of the present invention.

Figure 23:
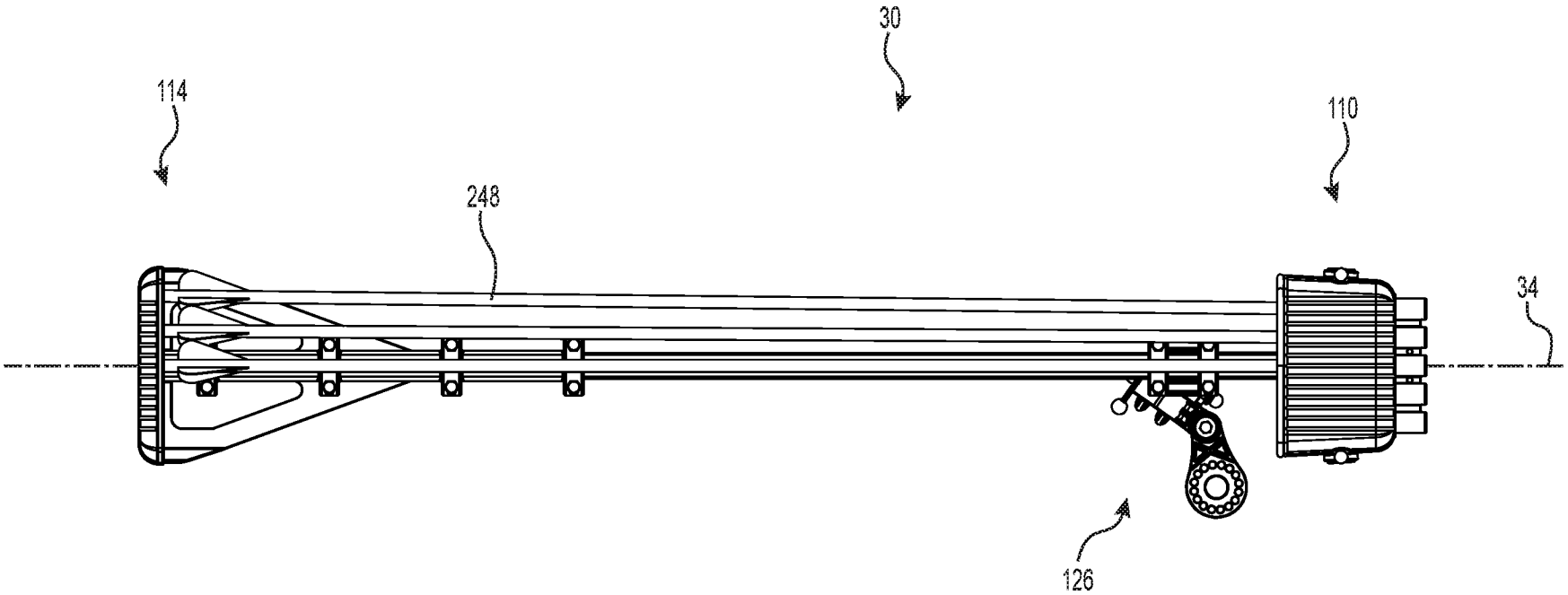
FIG. 23 is a top plan view of a quiver in accordance with embodiments of the present invention.

FIG. 20 throughout FIG. 23 are illustrating an embodiment of the quiver 30 capable of receiving five arrows 248 therein. The quiver securing mechanism 126 is illustrated in various positions with different angles thereof for illustrative purpose. The length of the quiver 30 is also depicted in different possible configurations. A skilled reader can appreciate from FIG. 20 a plurality of parallel longitudinal axes 34 that are aligned with each of the individual arrow receptables, each including its own arrow retaining mechanism 150 and corresponding aligned arrow nock-engaging element 166 (not directly visible through the arrow nock receiving portion 114.

Figure 24:
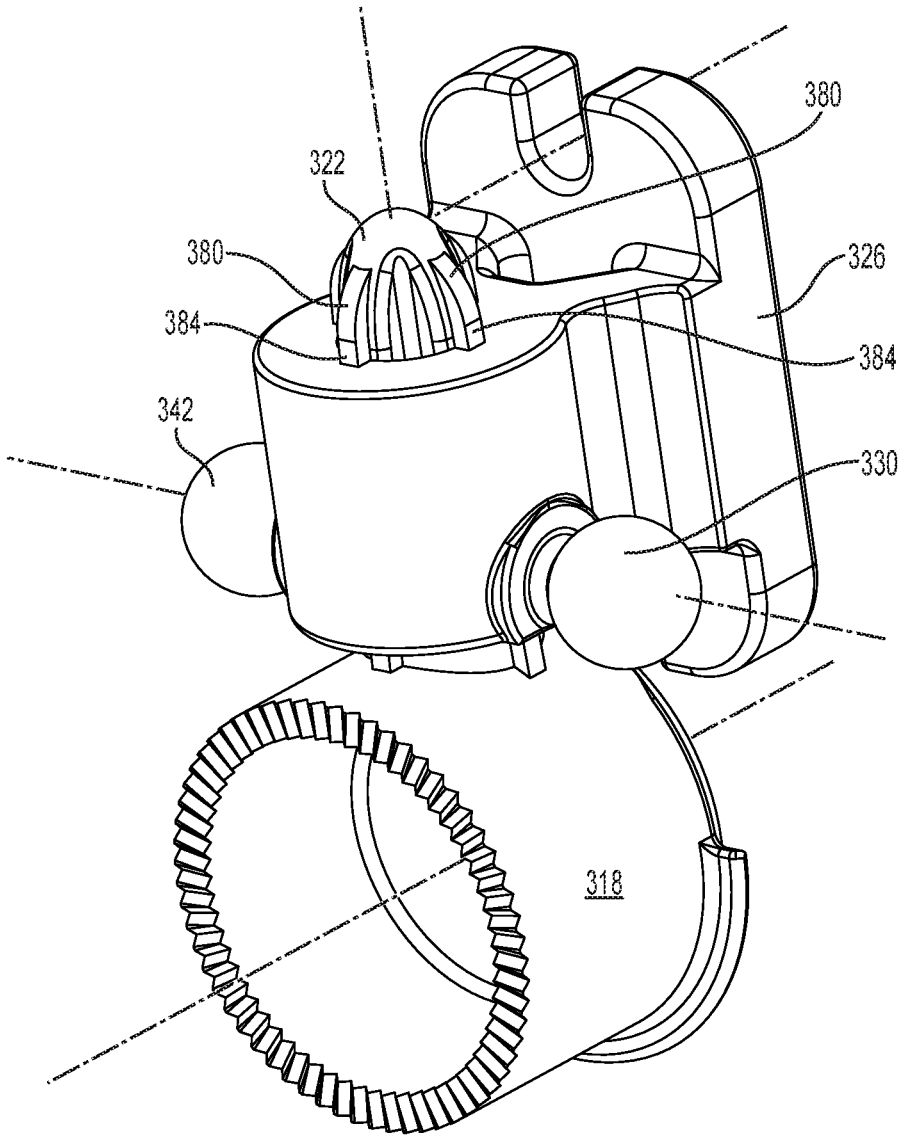
FIG. 24 is an isometric view of an alternate engagement member embodiment in accordance with embodiments of the present invention.
Figure 25:
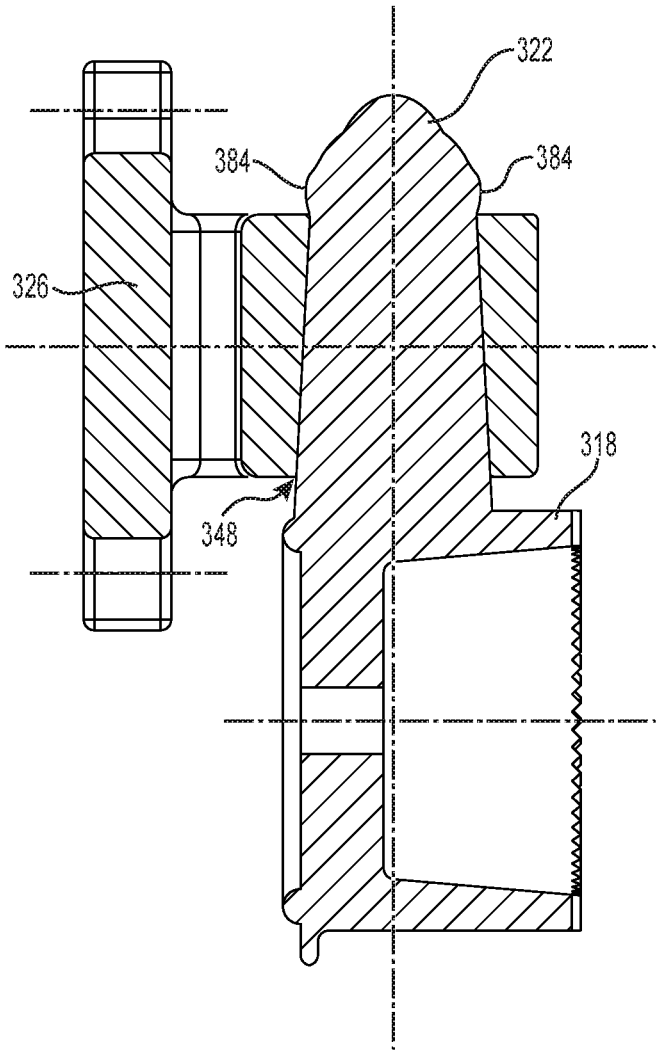
FIG. 25 is a section view of the alternate engagement member embodiment of FIG. 24 in accordance with embodiments of the present invention.
Figure 26:
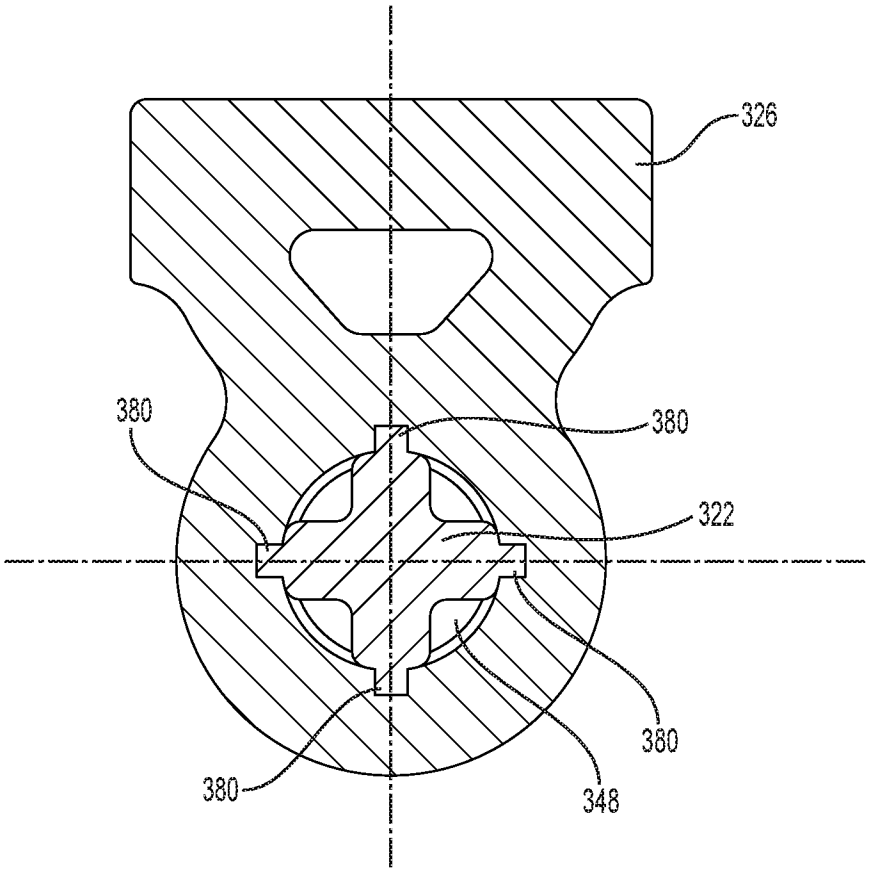
FIG. 26 is a section view of the alternate engagement member embodiment of FIG. 24 in accordance with embodiments of the present invention.
Figure 28:
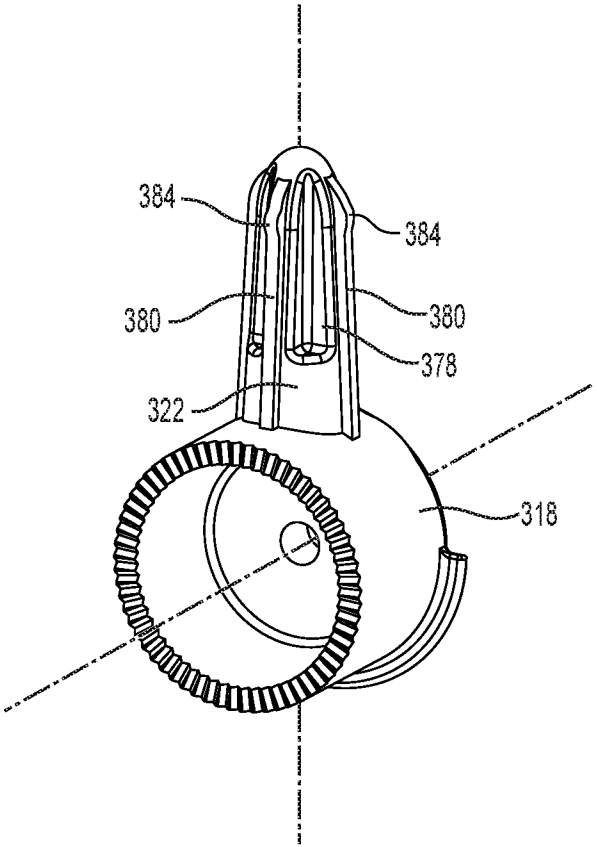
FIG. 28 is an isometric view of the alternate engagement member embodiment of FIG. 24 in accordance with embodiments of the present invention.
Figure 27:
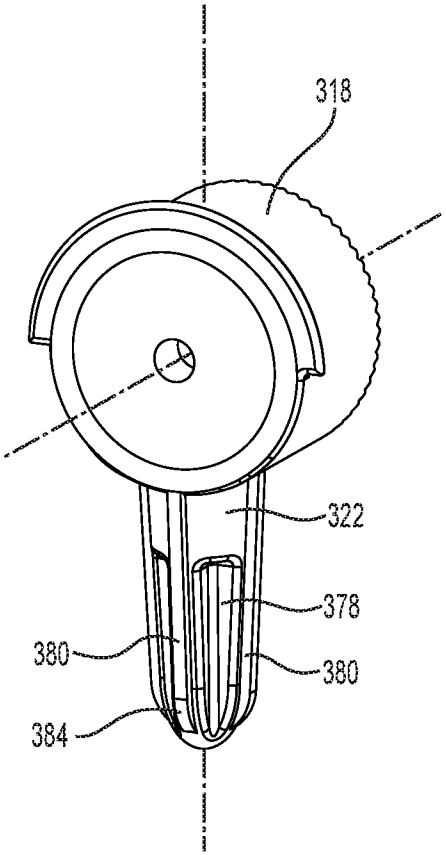
FIG. 27 is an isometric view of the alternate engagement member embodiment of FIG. 24 in accordance with embodiments of the present invention.
Figure 30:
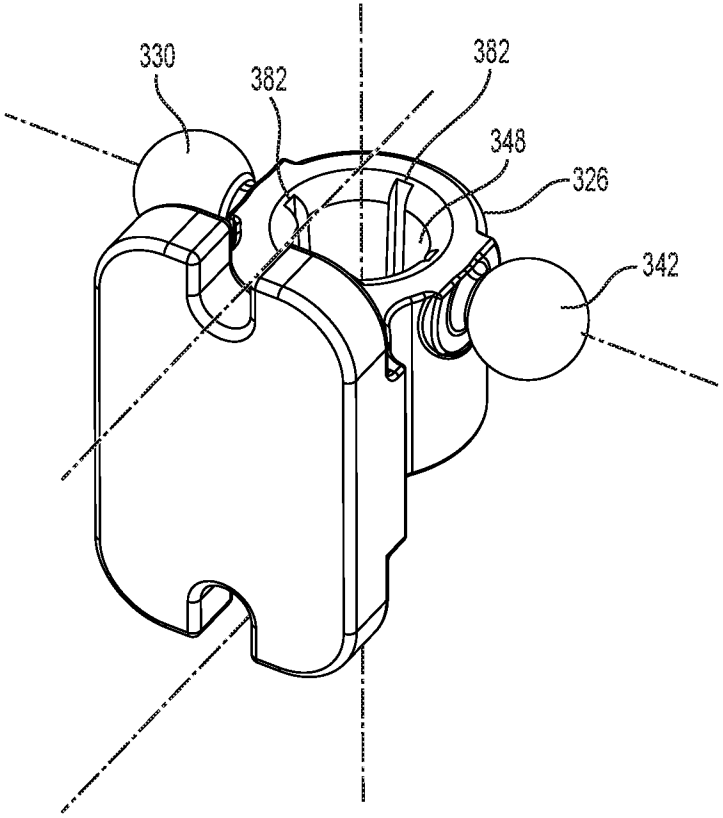
FIG. 30 is an isometric perspective view of a quiver and belt support in accordance with embodiments of the present invention.
Figure 29:
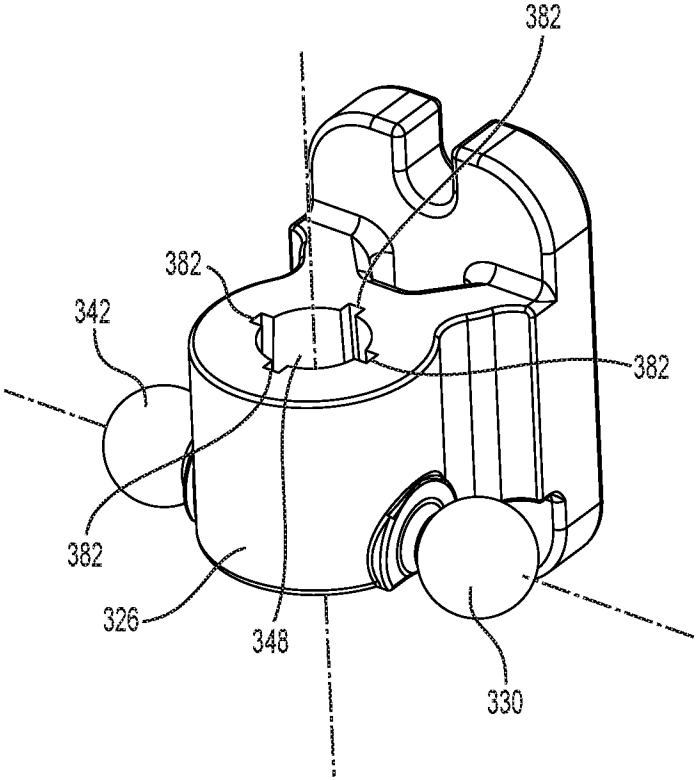
FIG. 29 is an isometric perspective view of a quiver and belt support in accordance with embodiments of the present invention.

FIG. 24 throughout FIG. 30 are illustrating an embodiment using a securing mechanism 126 including a single engagement member 322. This embodiment is preventing rotation of the connector 318 in respect with the support 326 with at least one engaging portion 380 extending from the securing mechanism 126. The engaging portion 380 is mechanically engaging corresponding engaging portion receivers 382 recessed in the support 326. The illustrated embodiment includes four (4) engaging portions 380 and a similar number of engaging portion receivers 382 for increased assembly strength. A different number of engaging portions 380 is encompassed by the present application if it happens a different design be desirable. One can appreciate the engagement member 322 includes radial contacting portions 378 with intervening voids. This design reduces the amount of material required for the assemble while allowing, for instance, four contact portions between the engagement member 322 and the support 326. The tip of either the radial contacting portions 378 or the engaging portions 380 are optionally provided with respective self-blocking protrusions 384. The self-blocking protrusions 384 are sized and designed to provide a small interference between the engagement member 322 and the support's engagement member receiver 348 to interlock the two parts when assembled. It is optional however desirable the belt 334 be used to further secure the assembly while the self-blocking protrusions 384 are temporarily holding the assembly in place.

Figure 31:
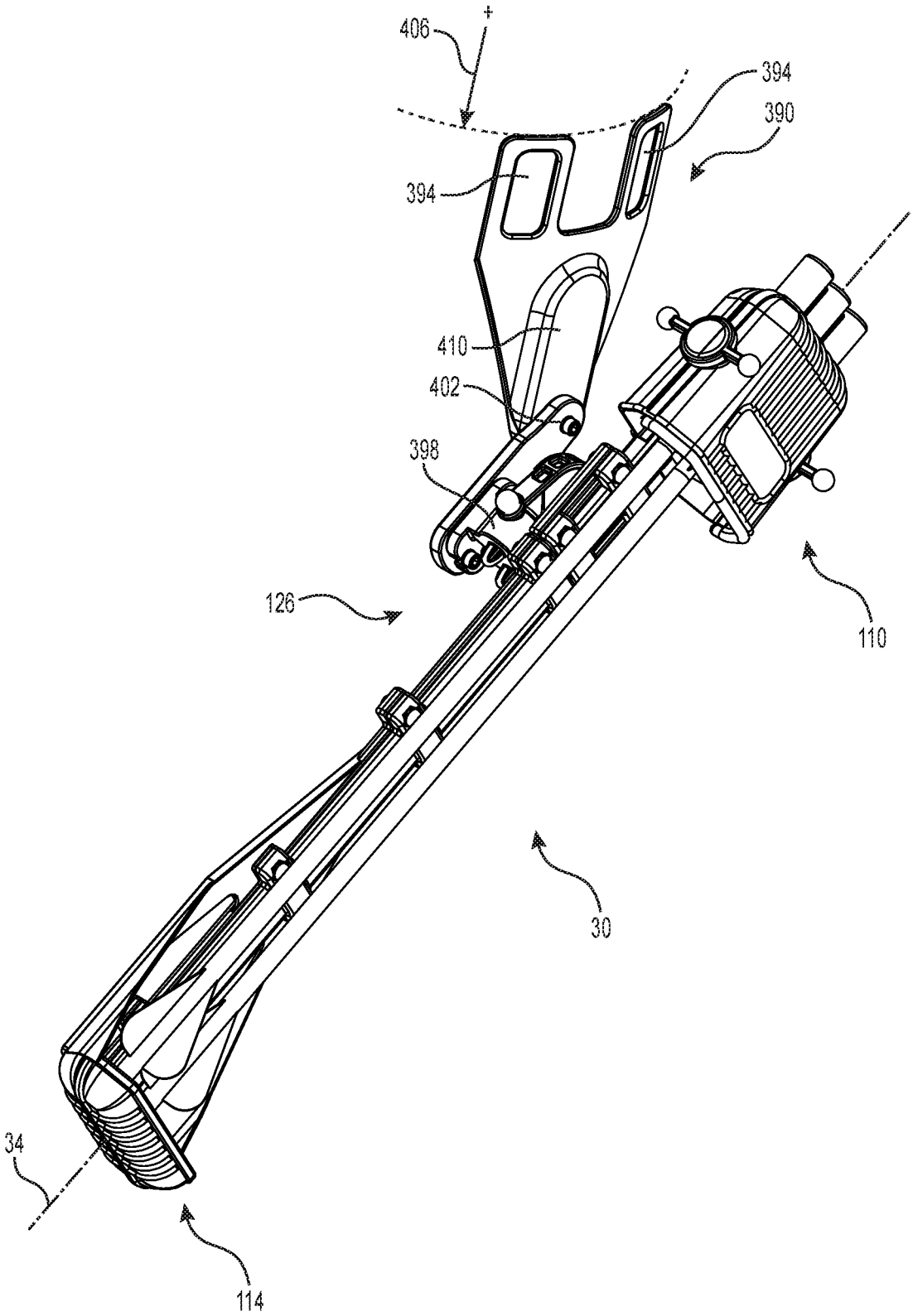
FIG. 31 is an isometric perspective view of a quiver and belt support in accordance with embodiments of the present invention.
Figure 32:
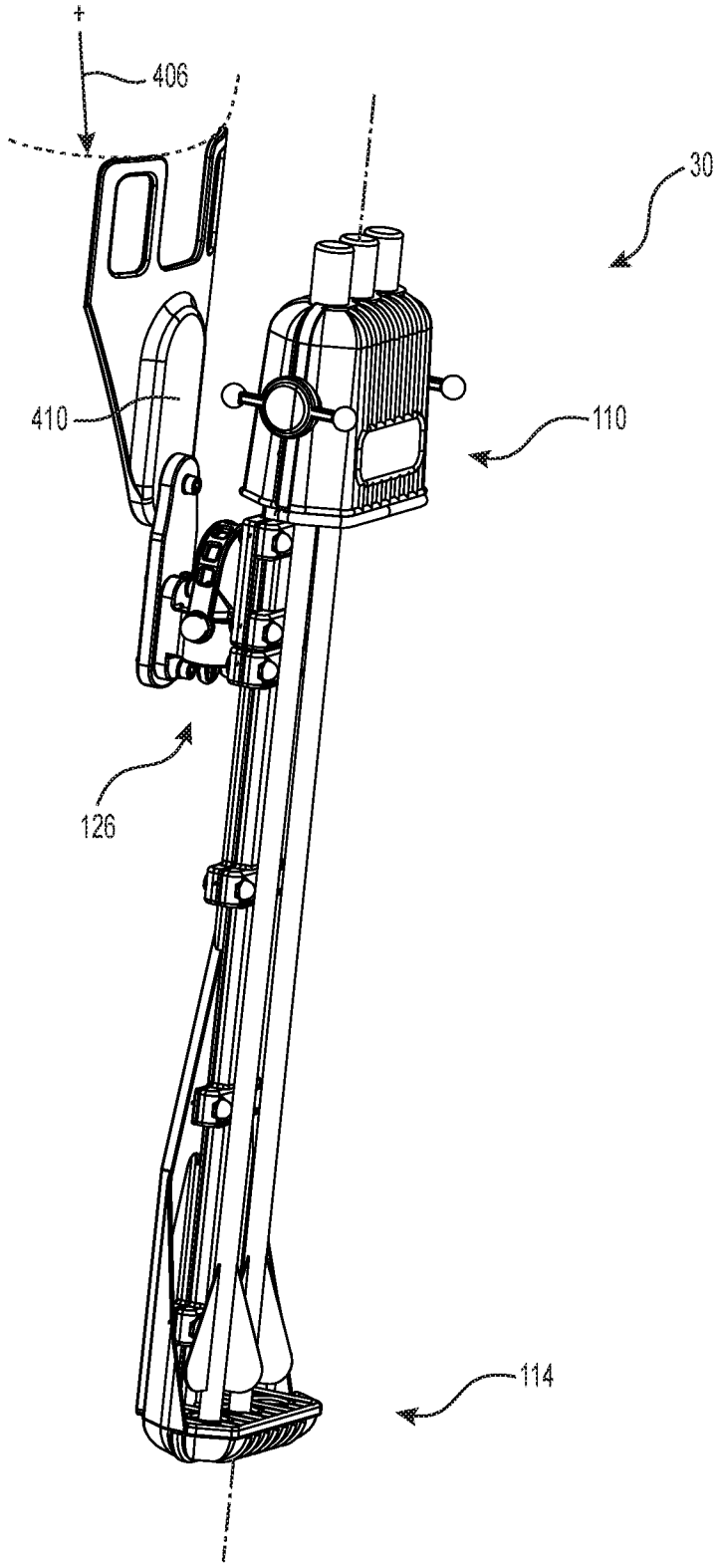
FIG. 32 is an isometric perspective view of a quiver and belt support in accordance with embodiments of the present invention.

Another embodiment illustrated in FIG. 31 and FIG. 32 allows a user to use a personal support 390 to carry the quiver 30. The personal support 390 includes openings 394 therein to receive therein a belt (not illustrated) to carry the quiver 30. The personal support 390 further includes a receiver 398 for engaging the pair of engagement members 322 therein to removably connect the quiver 30. An additional pivot 402 provided an additional degree of adjustment. The personal support 390 includes an optional curved portion 406 for ergonomical optimization and a protruding portion 410 for distancing the quiver 30 from the leg of the user and for giving some space to house securing elements used to connect the quiver 30 with the required components.

The description and the drawings that are presented above are meant to be illustrative of the present invention. They are not meant to be limiting of the scope of the present invention. Modifications to the embodiments described may be made without departing from the present invention, the scope of which is defined by the following claims:

What is claimed is:

1. A quiver for receiving and securing therein a plurality of arrows, the quiver comprising:

an arrow head receiving portion secured at a first end of an elongated frame, the arrow head receiving portion including a plurality of individual arrow retaining mechanisms;

each individual arrow retaining mechanism comprising an arrow head receiver for contacting an arrow head thereon;

a slidable plunger longitudinally connected to the arrow head receiver;

a plunger receiver longitudinally slidably connected to the plunger and individually housed and secured in a corresponding individual recess in the arrow head receiving portion;

a biasing element encapsulated between the plunger and the plunger receiver, the biasing element longitudinally biasing the plunger away from the plunger receiver that is remaining fixed with respect to the corresponding individual recess in the arrow head receiving portion; and an arrow nock receiving portion secured at a second end of the elongated frame, the arrow nock receiving portion including a plurality of individual nock-engaging elements, each one of the individual nock-engaging elements being longitudinally aligned along a respective arrow longitudinal axis with a cooperating arrow retaining mechanism of the arrow head receiving portion for securing an arrow with a force longitudinally biased against the arrow between the arrow retaining mechanism and the nock-engaging element.

2. The quiver of claim 1, wherein the corresponding recess of each arrow receiving portion is individually and longitudinally protruding from an arrow head receiving hood, the arrow head receiving hood being sized and designed for collectively protecting a plurality of arrow broadheads therein.

3. The quiver of claim 2, wherein the arrow head receiver is connected to the slidable plunger to compress an helicoidal spring housed between the slidable plunger and the plunger receiver to longitudinally bias the arrow head receiver toward the arrow nock receiving portion.

4. The quiver of claim 1, wherein the arrow longitudinal axis is parallel with a longitudinal axis of the quiver.

5. The quiver of claim 1, wherein the nock receiving portion includes a plurality of generally self-centering conical nock receivers.

6. The quiver of claim 1, wherein the arrow retaining mechanism includes a substantially self-centering conical arrow head receiver.

7. The quiver of claim 1, wherein the arrow nock receiving portion includes a pair of side edges extending into a pair of vanes skid guards for protecting vanes of arrows secured in the quiver.

8. The quiver of claim 1, wherein the arrow nock receiving portion includes an elongated frame receiver centrally disposed therein, the elongated frame being slidably adjustable in the elongated frame receiver to set a longitudinal length between the arrow head receiving portion and the arrow nock receiving portion.

9. The quiver of claim 1, wherein a quiver securing mechanism for securing the quiver to an object is secured to the elongated frame between the arrow head receiving portion and the arrow nock receiving portion.

10. The quiver of claim 1, wherein the arrow head receiving portion included two detachable portions.

11. An arrow propelling device equipped with a quiver for receiving and securing therein a plurality of arrows, the quiver comprising:

an arrow head receiving portion secured at a first end of an elongated frame, the arrow head receiving portion including a plurality of individual arrow retaining mechanisms;

each individual arrow retaining mechanism comprising an arrow head receiver for contacting an arrow head thereon;

a slidable plunger longitudinally connected to the arrow head receiver;

a plunger receiver longitudinally slidably connected to the plunger and individually housed and secured in a corresponding individual recess in the arrow head receiving portion;

a biasing element disposed between the plunger and the plunger receiver, the biasing element longitudinally biasing the plunger away from the plunger receiver that is remaining fixed with respect to the corresponding individual recess in the arrow head receiving portion; and an arrow nock receiving portion secured at a second end of the elongated frame, the arrow nock receiving portion including a plurality of individual nock-engaging elements, each one of the individual nock-engaging elements being longitudinally aligned along a respective arrow longitudinal axis with a cooperating arrow retaining mechanism of the arrow head receiving portion for securing an arrow with a force longitudinally biased against the arrow between the arrow retaining mechanism and the nock-engaging element.

12. The arrow propelling device of claim 11, wherein the corresponding recess of each arrow receiving portion is longitudinally and longitudinally protruding from an arrow head receiving hood, the arrow head receiving hood being sized and designed for collectively protecting a plurality of arrow broadheads therein.

13. The arrow propelling device of claim 12, wherein the arrow head receiver is connected to the slidable plunger to compress an helicoidal spring housed between the slidable plunger and the plunger receiver to longitudinally bias the arrow head receiver toward the arrow nock receiving portion.

14. The arrow propelling device of claim 11, wherein the arrow longitudinal axis is parallel with a longitudinal axis of the quiver.

15. The arrow propelling device of claim 11, wherein the nock receiver portion includes a plurality of generally self-centering conical nock receivers.

16. The arrow propelling device of claim 11, wherein the arrow retaining mechanism includes a substantially self-centering conical arrow head receiver.

17. The arrow propelling device of claim 11, wherein the arrow nock receiving portion includes a pair of side edges extending into a pair of vanes skid guards for protecting vanes of arrows secured in the quiver.

18. The arrow propelling device of claim 11, wherein the arrow nock receiving portion includes an elongated frame receiver centrally disposed therein, the elongated frame being slidably adjustable in the elongated frame receiver to set a longitudinal length between the arrow head receiving portion and the arrow nock receiving portion.

19. The arrow propelling device of claim 11, wherein a securing mechanism for securing the quiver to an object is secured to the elongated frame between the arrow head receiving portion and the arrow nock receiving portion.

20. The arrow propelling device of claim 11, wherein the arrow head receiving portion included two detachable portions.

* * * * *